US008126172B2

(12) United States Patent
Horbach et al.

(10) Patent No.: US 8,126,172 B2
(45) Date of Patent: Feb. 28, 2012

(54) SPATIAL PROCESSING STEREO SYSTEM

(75) Inventors: Ulrich Horbach, Canyon Country, CA (US); Eric Hu, Los Angeles, CA (US); Stefan Finauer, Anzing (DE); Yi Zeng, Thousand Oaks, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 1117 days.

(21) Appl. No.: 11/951,964

(22) Filed: Dec. 6, 2007

(65) Prior Publication Data

US 2009/0147975 A1 Jun. 11, 2009

(51) Int. Cl.
*H04R 5/02* (2006.01)
*H04R 5/04* (2006.01)
*H04R 5/00* (2006.01)

(52) U.S. Cl. ..... 381/303; 381/307

(58) Field of Classification Search ..... 381/303, 381/300, 304, 305, 307, 17–23, 61
See application file for complete search history.

(56) References Cited

U.S. PATENT DOCUMENTS 5,428,687 A * 6/1995 Willcocks et al. ..... 381/18
5,625,696 A * 4/1997 Fosgate ..... 381/18
5,642,423 A * 6/1997 Embree ..... 381/22
5,671,287 A * 9/1997 Gerzon ..... 381/17
5,742,688 A * 4/1998 Ogawa et al. ..... 381/17
6,553,121 B1 * 4/2003 Matsuo et al. ..... 381/17
6,697,491 B1 * 2/2004 Griesinger ..... 381/20
7,107,211 B2 * 9/2006 Griesinger ..... 704/228
7,257,230 B2 * 8/2007 Nagatani ..... 381/56
7,443,987 B2 * 10/2008 Griesinger ..... 381/20
7,447,321 B2 * 11/2008 Furge et al. ..... 381/86
7,490,044 B2 * 2/2009 Kulkarni ..... 704/501
7,526,093 B2 * 4/2009 Devantier et al. ..... 381/59
7,787,631 B2 * 8/2010 Faller ..... 381/20
7,822,496 B2 * 10/2010 Asada et al. ..... 700/94
2003/0039366 A1 * 2/2003 Eid et al. ..... 381/27
2004/0086130 A1 * 5/2004 Eid et al. ..... 381/20
2005/0031130 A1 * 2/2005 Devantier et al. ..... 381/58
2006/0256969 A1 * 11/2006 Takashima et al. ..... 381/17
2007/0110268 A1 * 5/2007 Konagai et al. ..... 381/335
2007/0160219 A1 * 7/2007 Jakka et al. ..... 381/22
2007/0223740 A1 * 9/2007 Reams ..... 381/119
2007/0297519 A1 * 12/2007 Thompson et al. ..... 375/241
2009/0154714 A1 * 6/2009 Sugawara ..... 381/17
2009/0304213 A1 * 12/2009 Cook et al. ..... 381/300
2010/0128880 A1 * 5/2010 Scholz ..... 381/17
2010/0208900 A1 * 8/2010 Amadu et al. ..... 381/17
2011/0051937 A1 * 3/2011 Ma et al. ..... 381/17
2011/0081024 A1 * 4/2011 Soulodre ..... 381/17
2011/0135098 A1 * 6/2011 Kuhr et al. ..... 381/17

OTHER PUBLICATIONS

Savioja, Lauri; Creating Interactive Virtual Acoustic Environments; J. Audio Eng. Soc.; vol. 47, No. 9; Sep. 1999; pp. 675-705.
Griesinger, David; Multichannel Matrix Surround Decoders for Two-Eared Listeners; AES 101st Convention; Nov. 8-11, 1996; Los Angeles, CA.

(Continued)

*Primary Examiner* — Edgardo San Martin
(74) *Attorney, Agent, or Firm* — The Eclipse Group LLP

(57) ABSTRACT

A spatial processing stereo system ("SPSS") that receives audio signals and a limited number of user input parameters associated with the spatial attributes of a room, such as "room size", "stage distance", and "stage width". The input parameters are used to define a listening room and generate coefficients, room impulse responses, and scaling factors that are used generate additional surround signals.

22 Claims, 27 Drawing Sheets

OTHER PUBLICATIONS

Gerzon, Michael A.; Optimum Reproduction Matrices for Multispeaker Stereo; J. Audio Eng. Soc.; vol. 40, No. 7/8; Jul./Aug. 1992; pp. 571-589.

Griesinger, David; Theory and Design of a Digital Audio Signal Processor for Home Use; J. Audio. Eng. Soc.; vol. 37, No. 1/2, Jan./Feb. 1989; pp. 40-50.

Jot, Jean-Marc, et al.; Analysis and Synthesis of Room Reverberation Based on a Statistical Time-Frequency Model; AES 103rd Convention; Sep. 26-29, 1997; New York, NY.

Torger, Anders, et al.; Real-Time Partitioned Convolution for Ambiophonics Surround Sound; IEEE Workshop on Applications of Signal Processing of Audio and Acoustics 2001; Oct. 21-24, 2001; pp. 195-198.

Reijnen, Antwan J., et al.; New Developments in Electro-Acoustic Reverberation Technology; AES 98th Convention; Feb. 25-28, 1995.

* cited by examiner

SPATIAL PROCESSING STEREO SYSTEM

BACKGROUND

1. Field of the Invention

The invention is generally related to a sound generation approach that generates spatial sounds in a listening room. In particular, the invention relates to modeling with only a few user input parameters the listening room responses for a two-channel audio input based upon adjustable real-time parameters without coloring the original sound.

2. Related Art

The aim of a high-quality audio system is to faithfully reproduce a recorded acoustic event while generating a three-dimensional listening experience without coloring the original sound, in places such as a listening room, home theater or entertainment center, personal computer (PC) environment, or automobile. The audio signal from a two-channel stereo audio system or device is fundamentally limited in its ability to provide a natural three-dimensional listening experience, because only two frontal sound sources or loudspeakers are available. Phantom sound sources may only appear along a line between the loudspeakers at the loudspeaker's distance to the listener.

A true three-dimensional listening experience requires rendering the original acoustic environment with all sound reflections reproduced from their apparent directions. Current multi-channel recording formats add a small number of side and rear loudspeakers to enhance listening experience. But, such an approach requires the original audio media to be recorded or captured from each of the multiple directions. However, two-channel recording as found on traditional compact discs (CDs) is the most popular format for high-quality music today.

The current approaches to creating three-dimensional listening experiences have been focused on creating virtual acoustic environments for hall simulation using delayed sounds and synthetic reverb algorithms with digital filters. The virtual acoustic environment approach has been used with such devices as headphones and computer speakers. The synthetic reverb algorithm approach is widely used in both music production and home audio/audio-visual components such as consumer audio/video receivers (AVRs).

In FIG. 1, a block diagram 100 illustrating an example of a listening room 102 with a traditional two-channel AVR 104 is shown. The AVR 104 may be in signal communication with a CD player 106 having a two-channel stereo output (left audio channel and a right audio channel), television 108, or other audio/video equipment or device (video recorders, turntables, computers, laser disc players, audio/video tuners, satellite radios, MP3 players). Audio device is being defined to include any device capable of generating two-channel or more stereo sound, even if such a device may also generate video or other signals.

The left audio channel carries the left audio signal and the right audio channel carries the right audio signal. The AVR 104 may also have a left loudspeaker 110 and a right loudspeaker 112. The left loudspeaker 110 and right loudspeaker 112 each receive one of the audio signals carried by the stereo channels that originated at the audio device, such as CD player 106. The left loudspeaker 110 and right loudspeaker 112 enables a person sitting on sofa 114 to hear two-channel stereo sound.

The synthetic reverb algorithm approach may also be used in AVR 104. The synthetic reverb algorithm approach uses tapped delay lines that generate discrete room reflection patterns and recursive delay networks to create dense reverb responses and attempts to generate the perception of a number of surround channels. However, a very high number of parameters are needed to describe and adjust such an algorithm in the AVR to match a listening room and type of music. Such adjustments are very difficult and time-consuming for an average person or consumer seeking to find an optimum setting for a particular type of music. For this reason, AVRs may have pre-programmed sound fields for different types of music, allowing for some optimization for music type. But, the problem with such an approach it the pre-programmed sound fields lack any optimization for the actual listening room.

Another approach to generate surround channels from two-channel stereo signals employs a matrix of scale factors that are dynamically steered by the signal itself. Audio signal components with a dominant direction may be separated from diffuse audio signals, which are fed to the rear generated channels. But, such an approach to generating sound channels has several drawbacks. Sound sources may move undesirably due to dynamic steering and only one dominant, discrete source is typically detected. This approach also fails to enhance very dryly recorded music, because such source material does not contain enough ambient signal information to be extracted.

Along with the foregoing considerations, the known approaches discussed above for generation of surround channels typically add "coloration" to the audio signals that is perceptible by a person listening to the audio generated by the AVR 104. Therefore, there is a need for an approach to processing stereo audio signals that filters the input channels and generates a number of surround channels while allowing a user to control the filters in a simple and intuitive way in order to optimize their listening experience.

SUMMARY

An approach to spatial processing of audio signals receives two or more audio signals (typically a left and right audio signal) and generates a number of additional surround sound audio signals that appear to be generated from around a predetermined location. The generation of the additional audio signals is customized by a user who inputs a limited number of parameters to define a listening room. A spatial processing stereo system then determines a number of coefficients, room impulse responses, and scaling factors from the limited number of parameters entered by the user. The coefficients, room impulse responses and scaling factors are then applied to the input signals that are further processed to generate the additional surround sound audio signals.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION

In the following description of examples of implementations of the present invention, reference is made to the accompanying drawings that form a part hereof, and which show, by way of illustration, specific implementations of the invention that may be utilized. Other implementations may be utilized and structural changes may be made without departing from the scope of the present invention.

Figure 1:
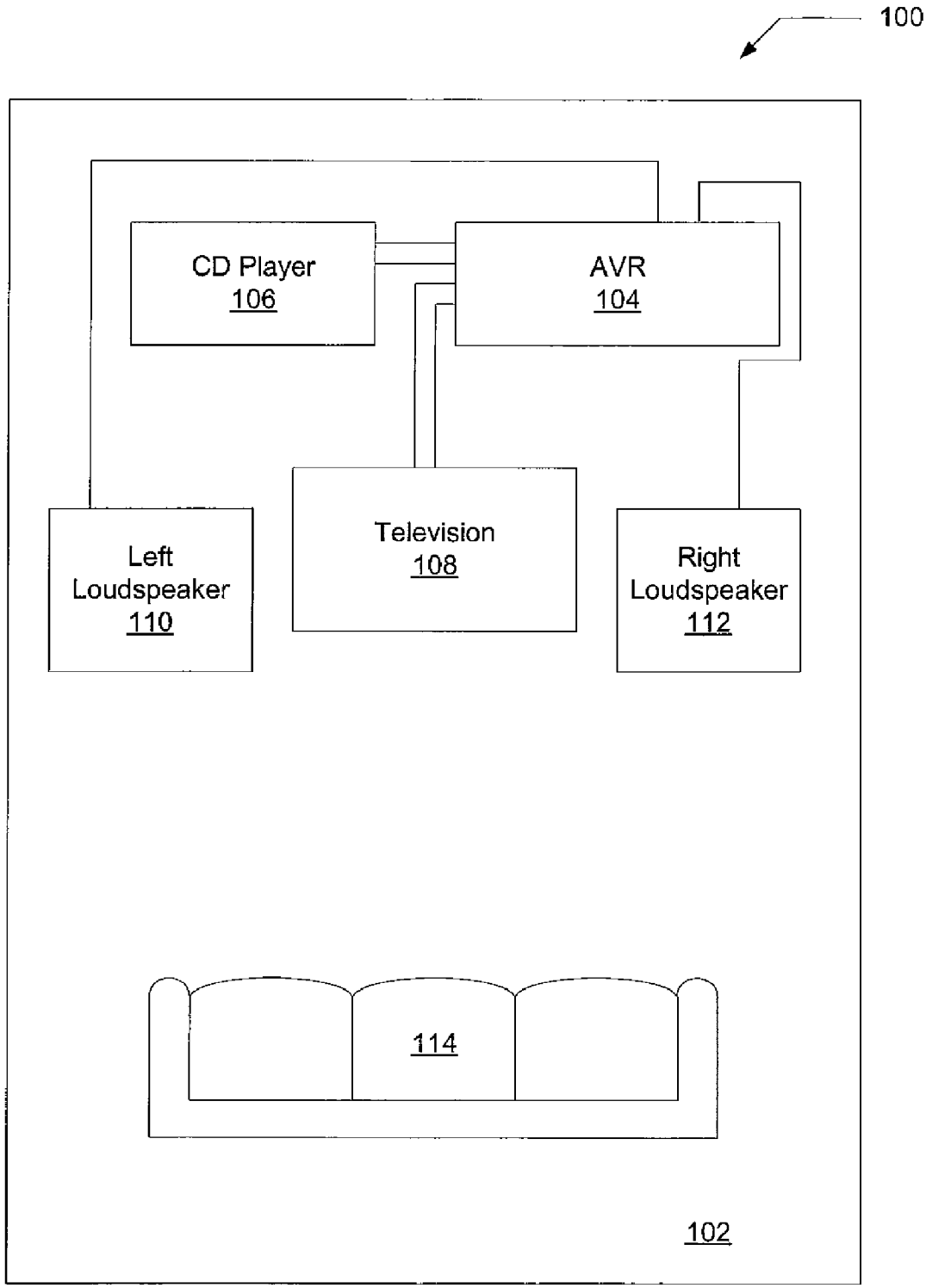
FIG.1 PRIOR ART
FIG. 1 shows a block diagram representation 100 illustrating an example listening room 102 with a typical room two-channel stereo system.
Figure 2:
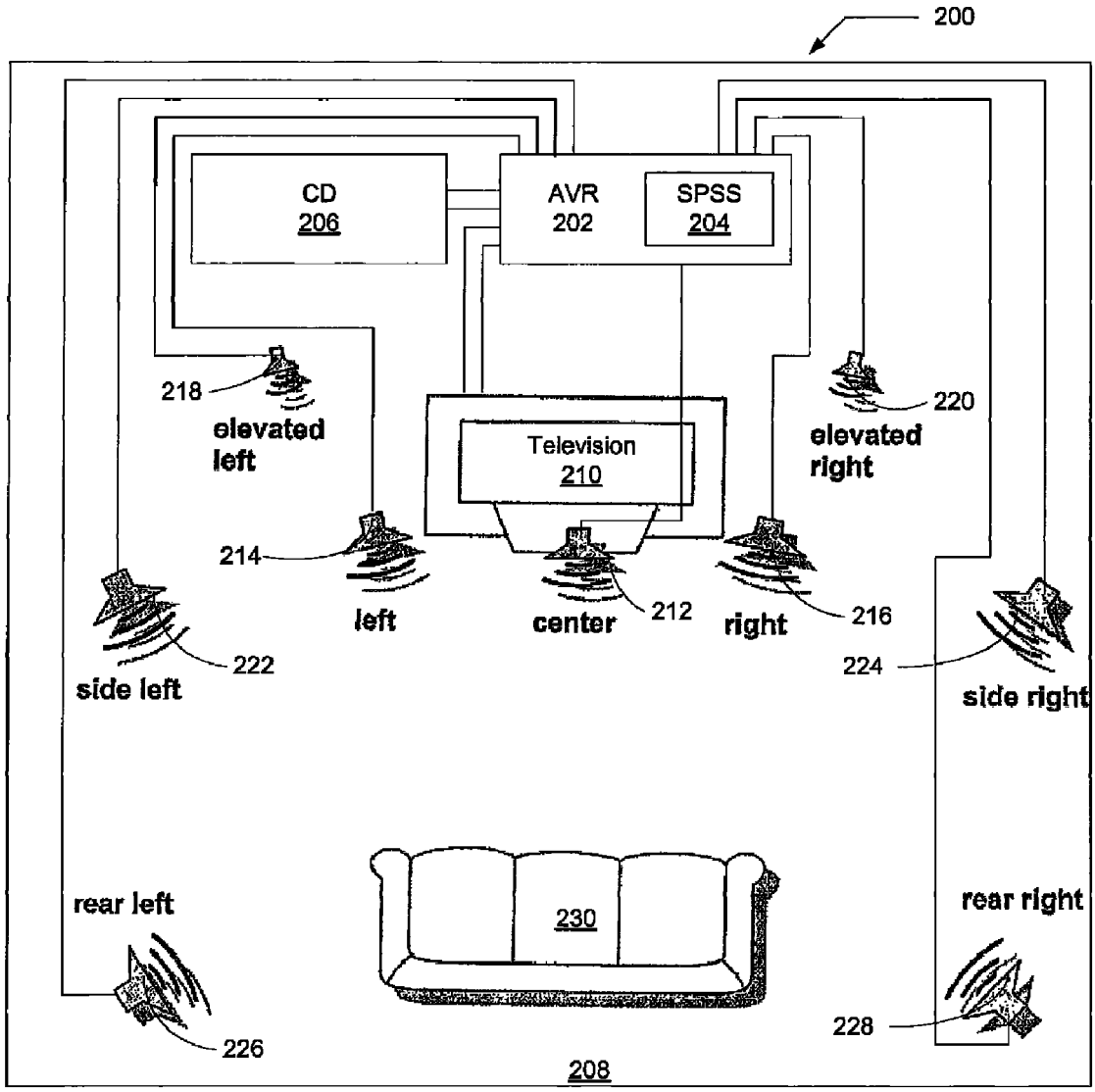
FIG. 2 shows a block diagram representation 200 illustrating an example of an AVR 202 having a spatial processing stereo system ("SPSS") 204 within listening room 208 in accordance with the invention.

Turning to FIG. 2, a block diagram illustrating an example of an AVR 202 having a spatial processing stereo system ("SPSS") 204 within listening room 208 in accordance with the invention is shown. The AVR 202 may be connected to one or more audio generating devices, such as CD player 206 and television 210. The audio generating devices will typically be two-channel stereo generating devices that connect to the AVR 202 with a pair of electrical cables, but in some implementations, the connection may be via fiber optic cables, or single cable for reception of a digital audio signal.

The SPSS 204 processes the two-channel stereo signal in such a way to generate seven audio channels in addition to the original left channel and right channel. In other implementations, two or more channels, in addition to the left and right stereo channels may be generated. Each audio channel from the AVR 202 may be connected to a loudspeaker, such as a center channel loudspeaker 212, four surround channel loudspeakers (side left 222, side right 224, rear left 226, and rear right 228), two elevated channeling loudspeakers (elevated left 218 and elevated right 220) in addition to the left loudspeakers 214 and right loudspeaker 216. The loudspeakers may be arranged around a central listening location or spot, such as sofa 230 located in listening room 208.

Figure 3:
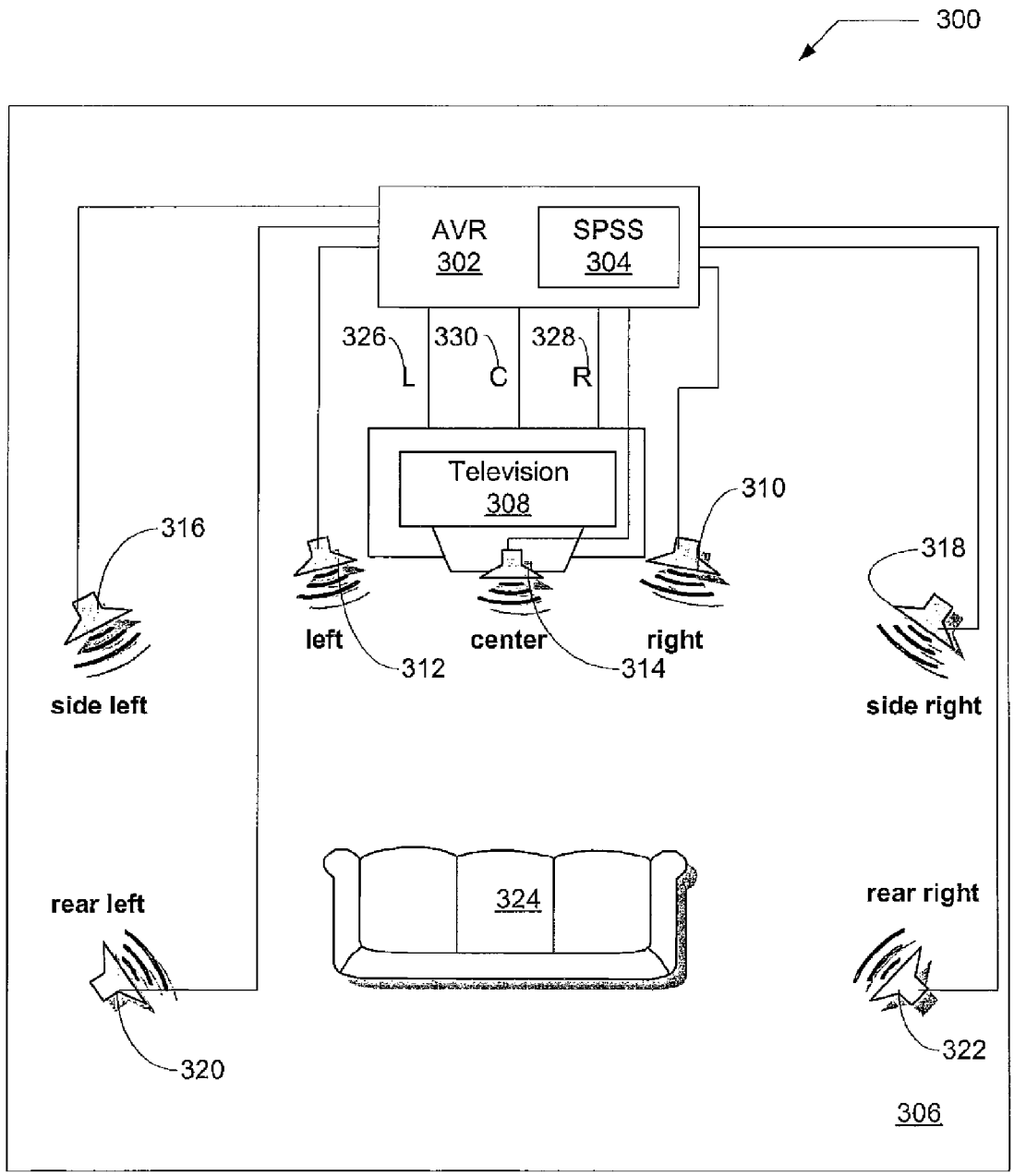
FIG. 3 shows a block diagram representation 300 illustrating another example of an AVR 302 having a SPSS 304 within listening room 306 in accordance with the invention.

In FIG. 3, a block diagram illustrating another example of an AVR 302 having a SPSS 304 connected to seven loudspeakers (310-322) within listening room 306 in accordance with the invention is shown. The AVR 302 is shown as connecting to a television via a left audio cable 326, right audio cable 328 and center audio cable 330. The SPSS 304 within the AVR 302 receives and processes the left, right and a center audio signal carried by the left audio cable 326, right audio cable 328, and center audio cable 330 and generates four additional audio signals. In other implementations, fiber optic cable may connect the television 308 or other audio/video components to the AVR 302. In order to generate the center channel, a known approach to center channel generation may be used within the television 308 to convert the mono or two channel stereo signal typically received by a television into three channels.

The additional four audio channels may be generated from the original right, left and center audio channels received from the television 308 and are connected to loudspeakers, such as the left loudspeaker 310, right loudspeaker 312 and center loudspeaker 314. The additional four audio channels are the rear left, rear right, side left and side right, and are connected to the rear left loudspeaker 320, rear right loudspeaker 322, side left loudspeaker 314, side right loudspeaker 318. All the loudspeakers may be located in a listing room 306 and placed relative to a central position, such as the sofa 324.

The connection to the loudspeakers may be via wires, fiber optics, or electro magnetic waves (radio frequency, infrared, Bluetooth, wireless universal serial bus, or other non-wired connections).

Figure 4:
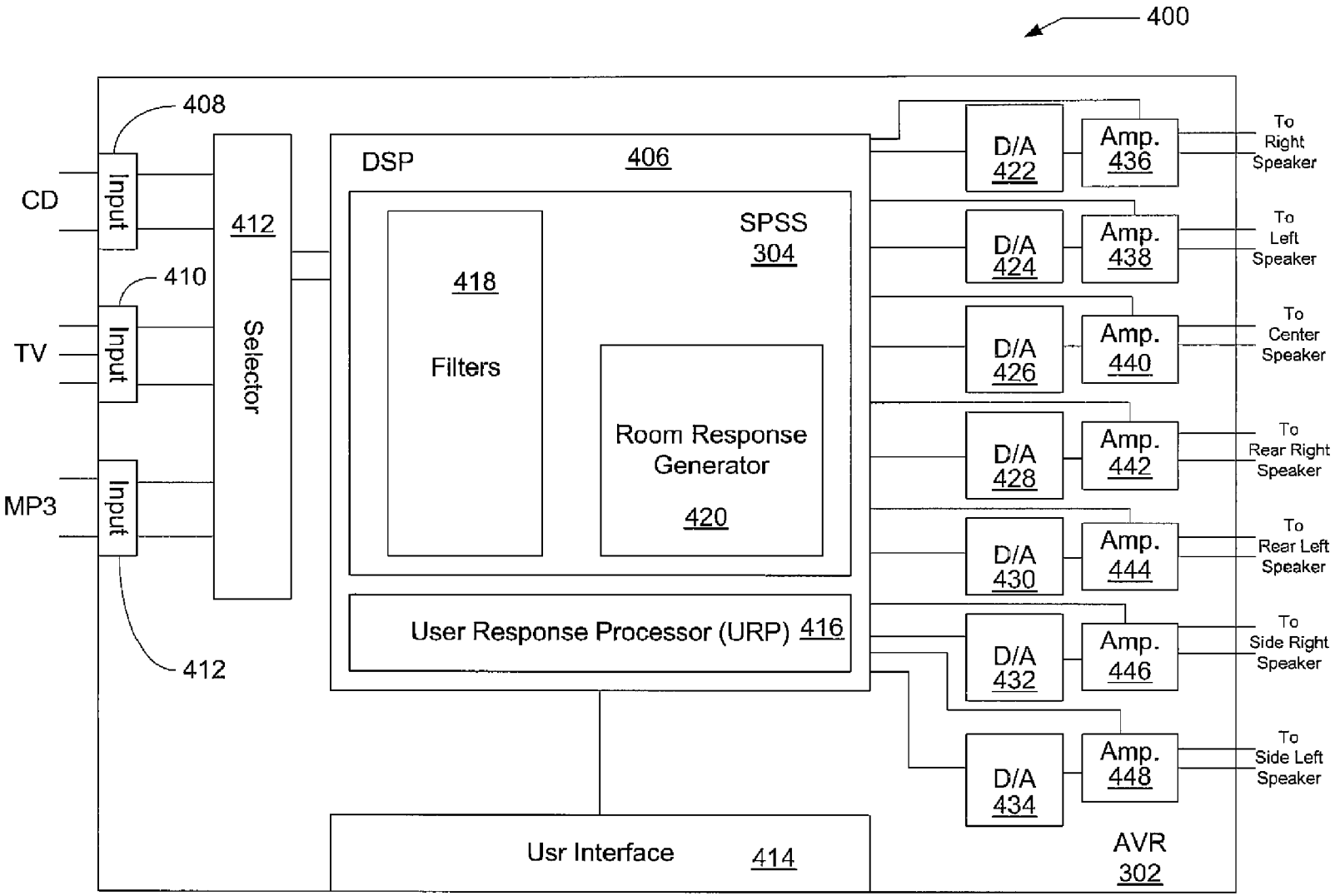
FIG. 4 shows a block diagram representation 400 of AVR 302 of FIG. 3 with SPSS 304 implemented in the digital signal processor (DSP) 406.

In FIG. 4, a block diagram of AVR 302 of FIG. 3 with SPSS 304 implemented in the digital signal processor (DSP) 406 is shown. Two-channel or three-channel stereo input signals from an audio device, such as CD player 206, television 308, or MP3 player 302 may be received at a respective input 408, 410, and 412 in AVR 304. A selector 412 may be located within the AVR 302 and control which of the two-channel stereo signals or three-channel stereo signals is made available to the DSP 406 for processing in response to the user interface 414. The user interface 414 may provide a user with buttons or other means (touch screen, mouse, touch pad, infra-red remote control, etc . . . ) to select one of the audio devices. Once a selection occurs at the user interface 414, the user response processor (URP) 416 in DSP 406 identifies the device detected and generates a notification that is sent to selector 412. The selector 412 may also have analog-to-digital converters that convert the two-channel stereo signals or three-channel stereo signals into digital signals for processing by the SPSS 304. In other implementations, the selector 412 may be directly controlled from the user interface 414 without involving the DSP 406 or other types of microprocessors or controllers that may take the place of DSP 406.

The DSP 406 may be a microprocessor that processes the received digital signal or a controller designed specifically for processing digital audio signals. The DSP 406 may be implemented with different types of memory (i.e. RAM, ROM, EEPROM) located internal to the DSP, external to the DSP, or a combination of internal and external to the DSP. The DSP 406 may receive a clock signal from an oscillator that may be internal or external to the DSP, depending upon implementation design requirements such as cost. Preprogrammed parameters, preprogrammed instructions, variables, and user variables for filters 418, URP 416, and room response generator 420 may be incorporated into or programmed into the DSP 406. In other implementations, the SPSS 304 may be implemented in whole or in part within an audio signal processor separate from the DSP 406.

The SPSS 304 may operate at the audio sample rate of the analog-to-digital converter (44.1 KHz in the current implementation). In other implementations, the audio sample rate may be 48 KHz, 96 KHz or some other rate decided on during the design of the SPSS. In yet other implementations, the audio sample may be variable or selectable, with the selection based upon user input or cable detection. The SPSS 304 may generate the additional channels with the use of linear filters 418. The seven channels may then be passed through digital-to-analog (D/A) converters 422-434 and results in seven analog audio signals that may be amplified by amplifiers 436-448. The seven amplified audio signals are then output to the speakers 310-322 of FIG. 3.

The URP 416 receives input or data from the user interface 414. The data is processed by the URP 416 to compute system variables for the SPSS 304 and may process other types of user interface input, such as input for the selector 412. The data for the SPSS 304 from the user interface 414 may be a limited set of input parameters related to spatial attributes, such as the three spatial attributes in the current implementation (stage width, stage distance, and room size).

The room response generator 420 computes a set of synthetic room impulse responses, which are filter coefficients. The room response generator 420 contains a statistical room model that generates modeled room impulse responses (RIRs) at its output. The RIRs may be used as filter coefficients for FIR filters that may be located in the AVR 302. A "room size" spatial attribute may be entered as an input parameter via the user interface 414 and processed by the URP 416 for generation of the RIRs by the room response generator 420. The "room size" spatial attribute input as an input parameter in the current implementation is a number in the range of 1 to 10, for example room_size=10. The room response generator 420 may be implemented in the DSP 406 as a background task or thread. In other implementations, the room response generator 420 may run off-line in a personal computer or other processor external to the DSP 406 or even the AVR 302.

Figure 5:
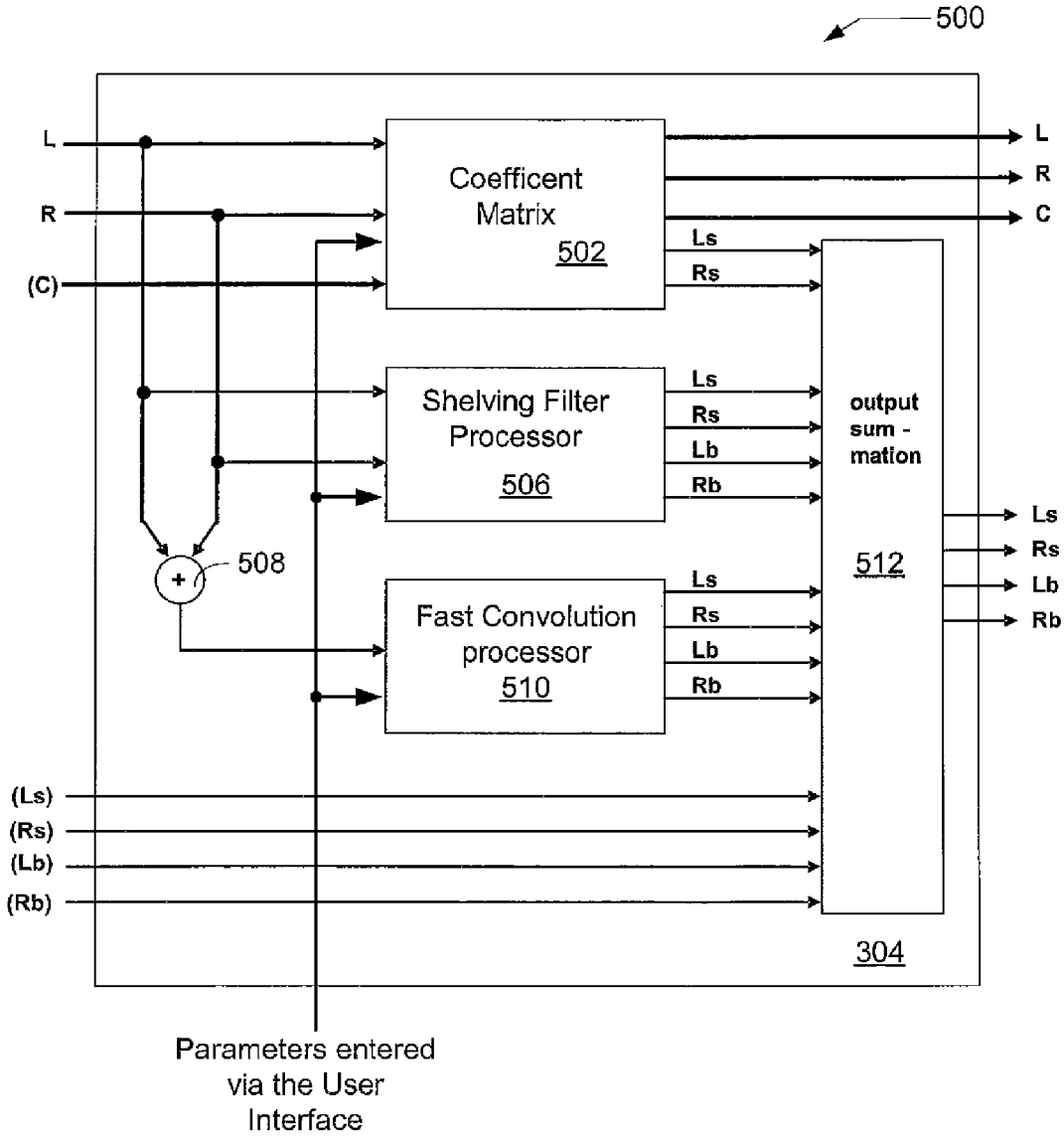
FIG. 5 shows a block diagram representation 500 of the SPSS 304 of FIG. 4.

Turning to FIG. 5, a block diagram 500 of the signal processing block 418 of the SPSS 304 of FIG. 4 is shown. The SPSS 304 generates audio signals for a number of surround channels. In the current example, seven audio channels are being processed by the SPSS 304. The input audio signals may be from a two-channel (left and right), three channel (left, right and center), or a multichannel (left, right, center, left side, right side, left back, and right back) source. In other implementations, a different number of input channels may be made available to the SPSS 304 for processing. The input channels will typically carry an audio signal in a digital format when received by the SPSS 304, but in other implementations the SPSS may include A/D converters to convert analog audio signals to digital audio signals.

In the current implementation, a coefficient matrix 502 receives the left, right and center audio inputs. The coefficient matrix 502 is created in association with a "stage width" input parameter that is entered via the user interface 414 of FIG. 4. The left, right, and center channels' inputted audio signals are processed with the coefficient matrix that generates a weighted linear combination of the audio signals. The resulting signals are the left, right, center, left side and right side audio signals and are typically audio signals in a digital format.

The left and right audio inputs may also be processed by a shelving filter processor 506. The shelving filter processor 506 applies shelving filters along with delay periods to the left and right audio signals inputted on the left and right audio inputs. The shelving filter processor 506 may be configured using a "stage distance" parameter that is input via the user interface 414 of FIG. 4. The "stage distance" parameter may be used to aid in the configuration of the shelving filters and delay periods. The shelving filter processor 506 generates the left side audio signal, right side audio signal, left back audio signal and the right back audio signal and are typically in a digital format.

The left and right audio inputs may also be summed by a signal combiner 508. The combined left and right audio inputs may then be processed by a fast convolution processor 510 that uses the "room size" input parameter. The "room size" input parameter may be entered via the user interface 414 of FIG. 4. The fast convolution processor 510 enables the generated left side, right side, left back and right back output audio signals to be adjusted for apparent room size.

The left side, right side, left back and right back audio signals generated by the coefficient matrix 502, shelving filters box 506, and fast convolution processor 510, along with the left side, right side, left back and right back input audio signals inputted from all audio source are respectively combined. A sound field such as a five or seven channel stereo signal may also be selected via the user interface 414 and applied to or superimposed on the respectively combined signals to achieve a final audio output for the left side, right side, left back and right back output audio signals.

Figure 6:
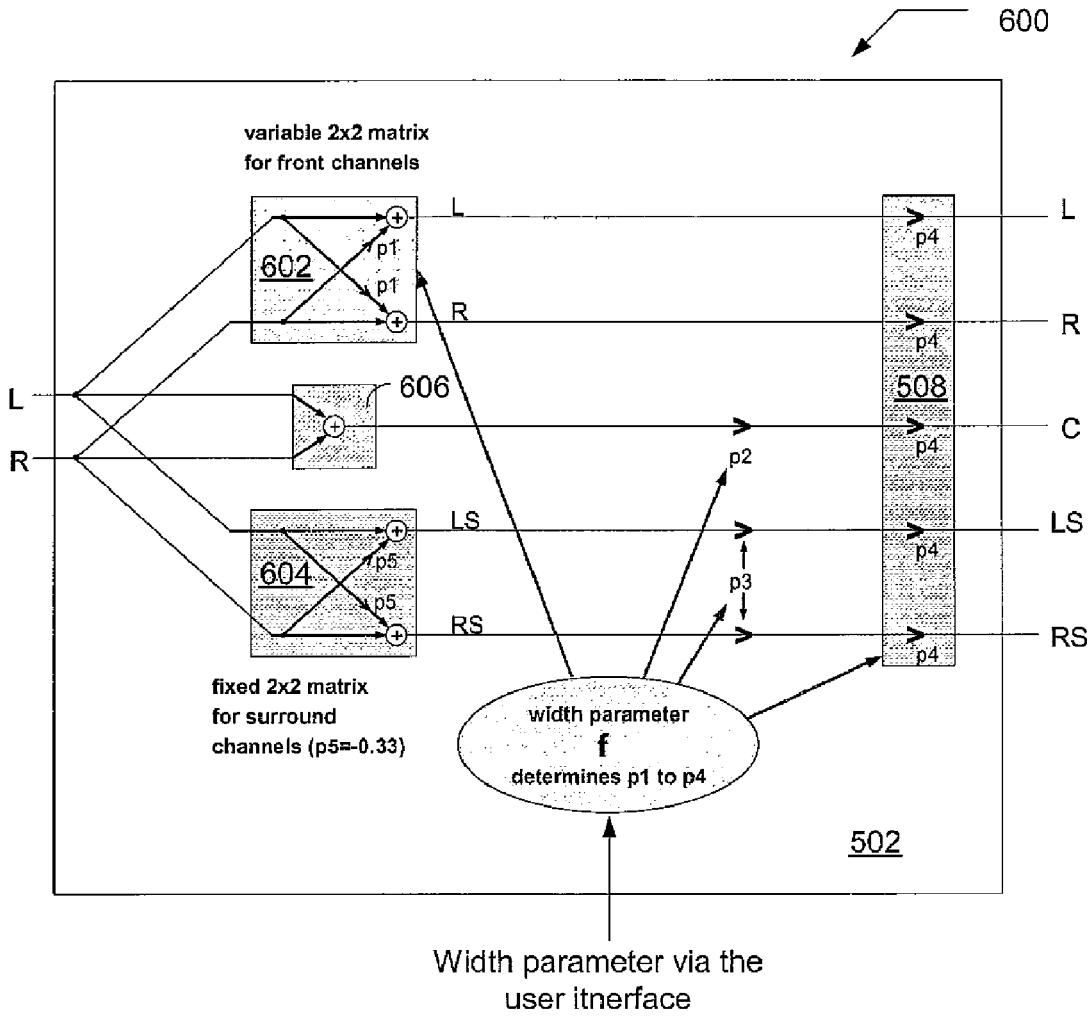
FIG. 6 shows a block diagram representation 600 of an example of the coefficient matrix 502 of FIG. 5 with a two-channel audio input.

In FIG. 6, a block diagram representation 600 of an example of the coefficient matrix 502 of FIG. 5 with a two-channel (left and right channel) audio source is shown. The left audio signal from the left channel and the right audio signal from the right channel are received at a variable 2×2 matrix 602. The variable 2×2 matrix may have a crosstalk coefficient p1 that is dependent with the "stage width" input parameter and results in the left audio signal and the right audio signal. The left audio signal and the right audio signal are received by a fixed 2×2 matrix 604 that employs a static coefficient p5. The static coefficient p5 may be set to a value of −0.33. Positive values for the coefficient have the effect of narrowing the sound stage, while negative coefficients widen the sound stage.

The center audio signal may be generated by the summation of the received left audio signal with the received right audio signal in a signal combiner 606. The signal combiner 606 may also employ a weight factor p2 that is dependent upon the state width parameter. The left side output signal and the right side output signal may also be scaled by a variable factor p3. All output signals (left, right, center, left side, and right side) may also be scaled by a common factor p4. The scale factors are determined by the URP 416 of FIG. 4.

The stage width input parameter is an angular parameter $\phi$ in the range of zero to ninety degrees. The parameter controls the perceived width of the frontal stereo panorama, from minimum zero degrees to a maximum of ninety degrees. The scale factors p1-p4 are derived in the present implementation with the following formulas:

$$p_1=0.3\cdot[\cos(2\pi\phi/180)-1],$$

$$p_2=0.01\cdot[80+0.2\cdot\phi],\text{ with center at input,}$$

$$p_2=0.01\cdot[50+0.2\cdot\phi],\text{ without center at input,}$$

$$p_3=0.0247\cdot\phi,$$

$$p_4=1/\sqrt{1+p_1^2+p_2^2+P_3^2(1+p_5^2)},$$

$$\phi\epsilon[0\ldots 90°].$$

The mappings are empirically optimized, in terms of perceived loudness, regardless of the input signals and chosen width setting, and in terms of uniformity of the image across the frontal stage. The output scale factor p4 normalizes the output energy for each width setting.

Figure 7:
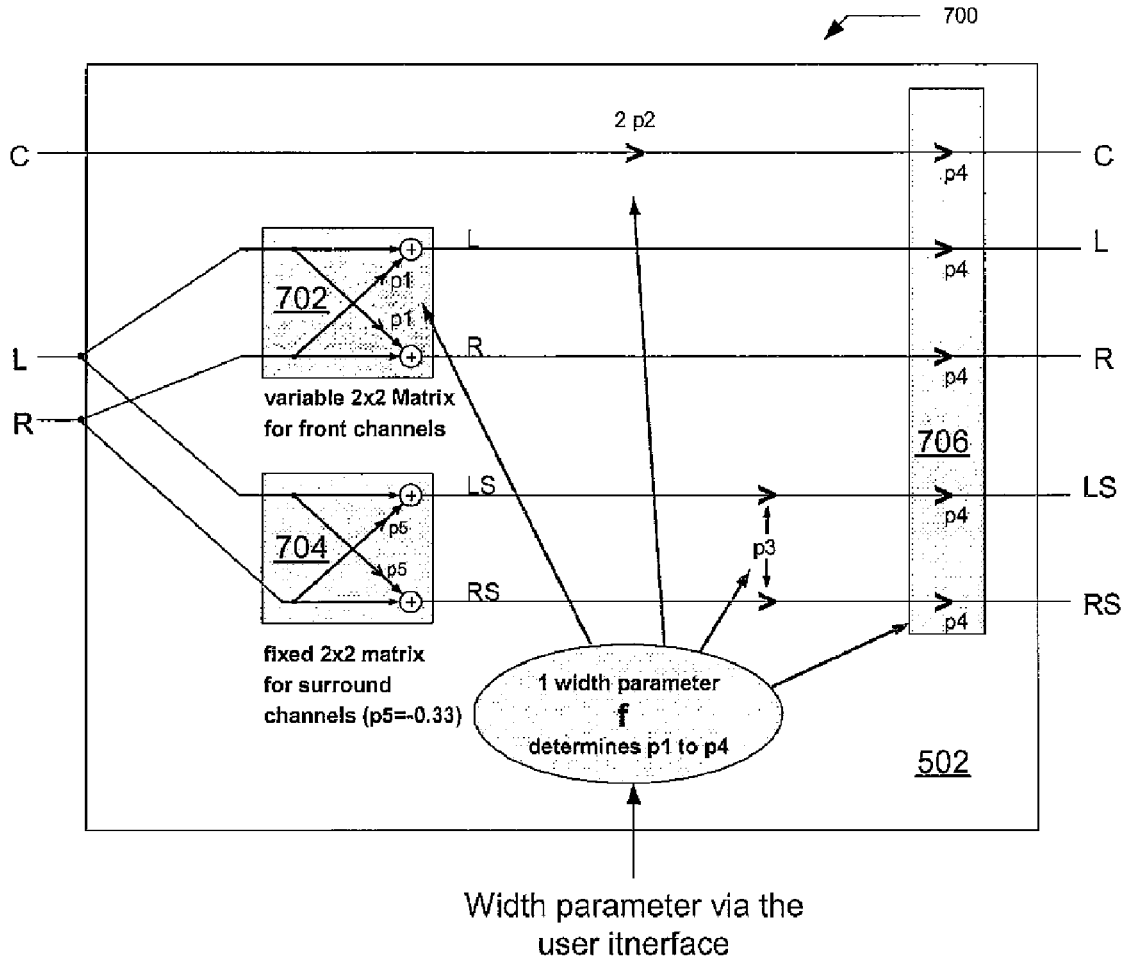
FIG. 7 shows a block diagram representation 700 of an example of the coefficient matrix 502 of FIG. 5 with a three-channel audio input.

Turning to FIG. 7, a block diagram representation 700 of an example of the coefficient matrix 502 of FIG. 5 with a three-channel (left, right, and center channel) audio source is shown. The right and left input audio is processed by a variable 2×2 matrix 702 and a fixed 2×2 matrix 704 as described in FIG. 6. The center channel audio input is weighted by 2 times a weight factor p2 and then scaled by the common factor p4. The crosstalk coefficient p1, weight factor p2, variable factor p3, common factor p4, and static coefficient p5 may be derived from the "stage width" input parameter that may be entered via the user interface 414 of FIG. 4.

Figure 8:
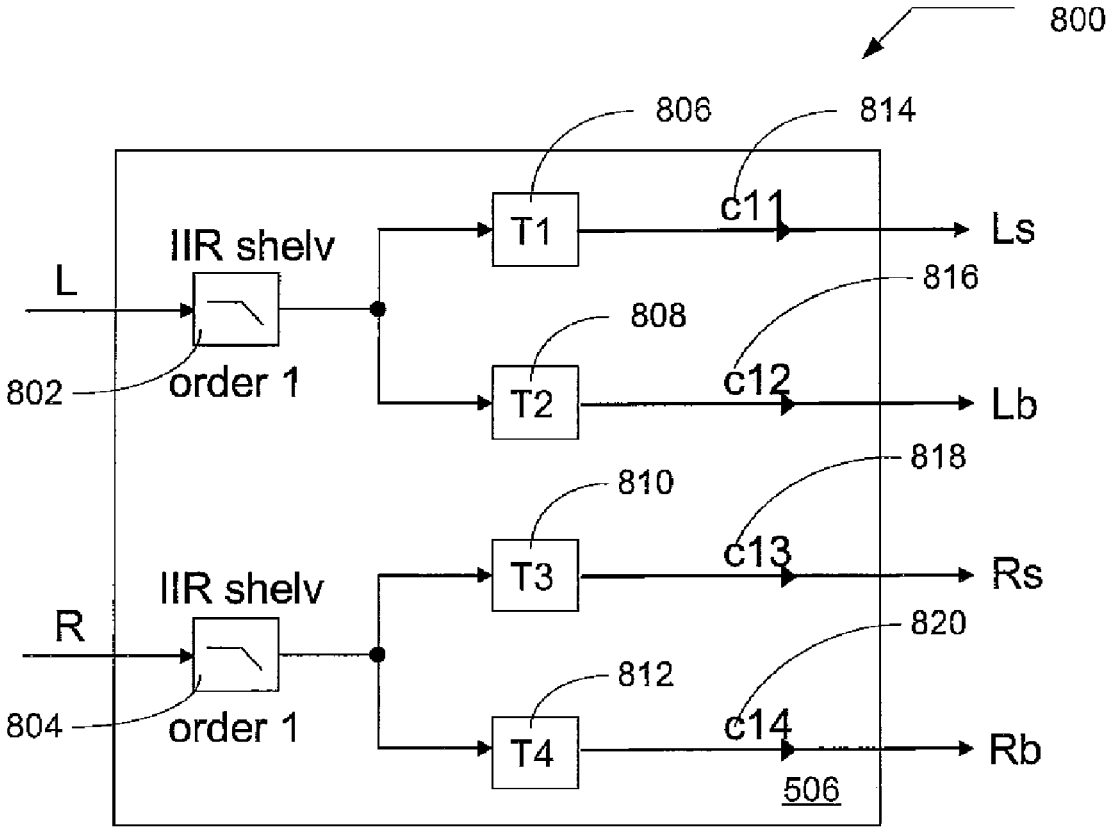
FIG. 8 shows a block diagram representation 800 of an example of the shelving filter processor 506 of FIG. 5 with a two-channel audio input.

In FIG. 8, a block diagram representation 800 of an example of the shelving filter processor 506 of FIG. 5 with a two-channel audio input is shown. The purpose of the shelving filter processor 506 is to simulate discrete reflected sound energy, as it occurs in natural acoustic environments (e.g. performance halls). The reflected sound energy provides cues for the human brain to estimate the distance of the sound sources. In the current implementation, each loudspeaker produces one reflection from its particular location. Reflections from the side loudspeakers significantly aid the simulated sensation of distance. In simpler terms, the shelving filter processor 506 models the frequency response alteration when sound is bounced off a wall and some absorption of the sound occurs.

The shelving filter process 506 receives the left audio signal at a first order high-shelving filter 802. Similarly, the shelving filter process 506 receives the right audio signal at another first order high shelving filter 804. The parameters of the shelving filters 802 and 804 may be gain "g" and corner frequency "$f_{cs}$" and depend on the intended wall absorption properties of a modeled room. In the current implementation, "g" and "$f_{cs}$" may be set to fixed values for convenience. Delays T1 806, T2 808, T3 810, and T4 812 are adjusted according to the intended stage distance parameter as determined by the URP 416 entered via the user interface 414. The resulting signals left side, left back, right side, and right back are attenuated by c11 814, c12 816, c13 818, and c14 820 respectively, resulting in attenuated signals left side, left back, right side, and right back.

Figure 9:
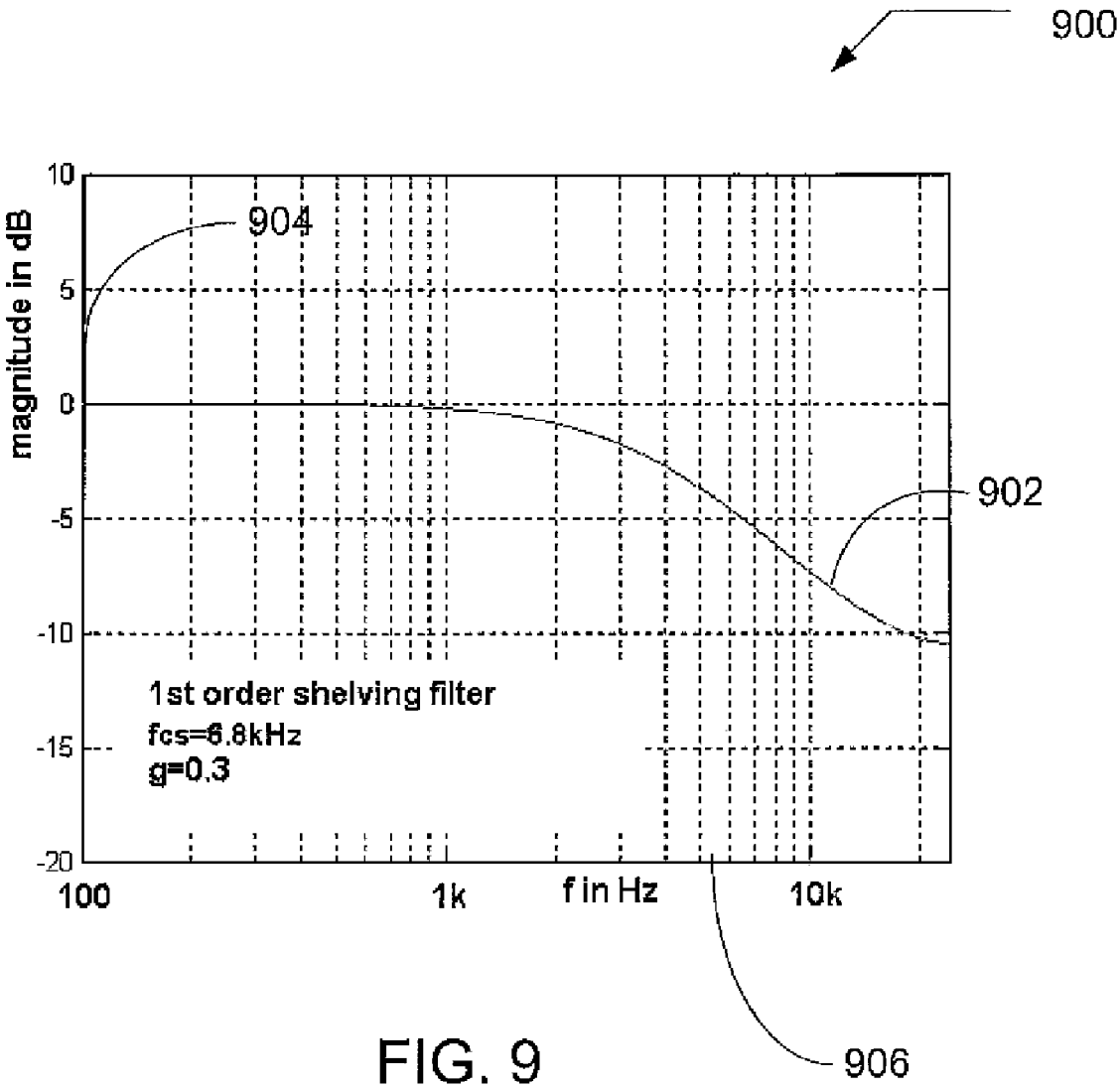
FIG. 9 depicts a graph 900 of the response 902 of the first order shelving filters 802 and 804 of FIG. 8.

Turning to FIG. 9, a graph 900 of the response 902 of the first order shelving filters 802 and 804 of FIG. 8 is depicted. The vertical axis 904 of the graph 900 is in decibels and the horizontal axis 906 is in Hertz. The gain "g" is set to 0.3 and corner frequency "$f_{cs}$" is set to 6.8 kHz resulting in a response plot 902 from the first order shelving filters 802 and 804 within the shelving filter processor 506.

Figure 10:
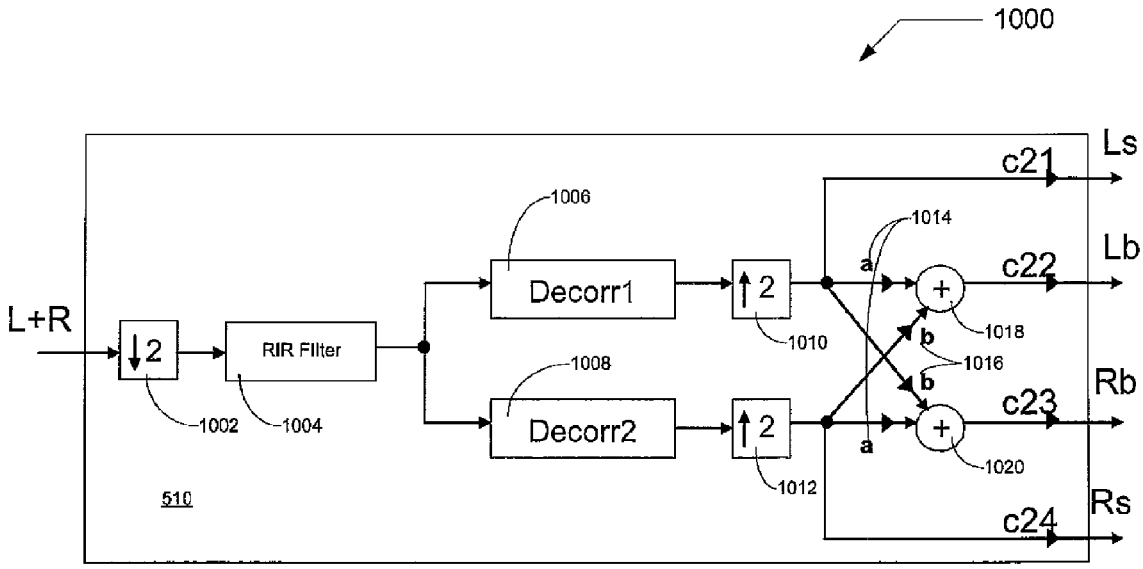
FIG. 10 is a block diagram representation 1000 of the fast convolution processor 510 of FIG. 5 with a combined left audio signal and right audio signal as an input.

In FIG. 10, a block diagram 1000 of the fast convolution processor 510 of FIG. 5 with a combined left audio signal and right audio signal as an input is shown. The combined left audio signal and right audio signal are down-sampled by a factor of two in the current implementation via a finite impulse response (FIR) filter (decimation filter) 1002. Another FIR filter that may have a long finite impulse response, such as 10,000-60,000 samples then realizes a simulated room impulse response (RIR) filter 1004 with coefficient that are stored in memory and generated previously by the room response generator 420. The RIR filter 1004 may be implemented using partitioned fast convolutions. The use of partitioned fast convolutions reduces computation cost when compared to direct convolution in the time domain and has lower latency than conventional fast convolutions in the frequency domain. The reduced computation cost and lower latency are achieved by splitting the RIR filter 1004 into uniform partitions. For example, a RIR filter of length 32768 may be split into 128 partitions of length 256. The output signal is a sum of 128 delayed signals generated by the 128 sub-filters of length 256, respectively.

The pair of shorter decorrelation filters 1006 and 1008 with a length between 500-2,000 coefficients generates decorrelated versions of the room response. The impulse response of the decorrelation filters 1006 and 1008 may be constructed by using an exponentially decaying random noise sequence with normalization of its complex spectrum by the magnitude spectrum. With the resulting time domain signal computed with an inverse fast Fourier transform (FFT). The resulting filter may be classified as an all-pass filter and does not alter the frequency response in the signal path. However, the decorrelation filters 1006 and 1008 do cause time domain smearing and re-distribution, thereby generating decorrelated output signals when applying multiple filters with different random sequences.

The output from the decorrelation filters 1006 and 1008 are up-sampled by a factor of two respectively, by up-samplers 1010 and 1012. The resulting audio signal from the up-sampler 1010 is the left side audio signal that is scaled by a scale factor c21. The resulting audio signal from the up-sampler 1012 is the right audio signal that is scaled by a scale factor c24. The Ls and Rs are then used to generate the left back audio signal and right back audio signal.

The left back and right back audio signals are generated by another pair of decorrelated outputs using a simple 2×2-matrix with coefficients "a" 1014 and "b" 1016. Coefficients are chosen such that the center signal in the resulting stereo mix is attenuated, and the lateral signal (stereo width) amplified (for example a=0.3 and b=−0.7). The signals in the 2×2 matrix are combined by mixers 1018 and 1020. The resulting left back audio signal from mixer 1018 is scaled by a scale factor c22 and the resulting right back audio signal from mixer 1020 is scaled by a scale factor of c23.

Figure 11:
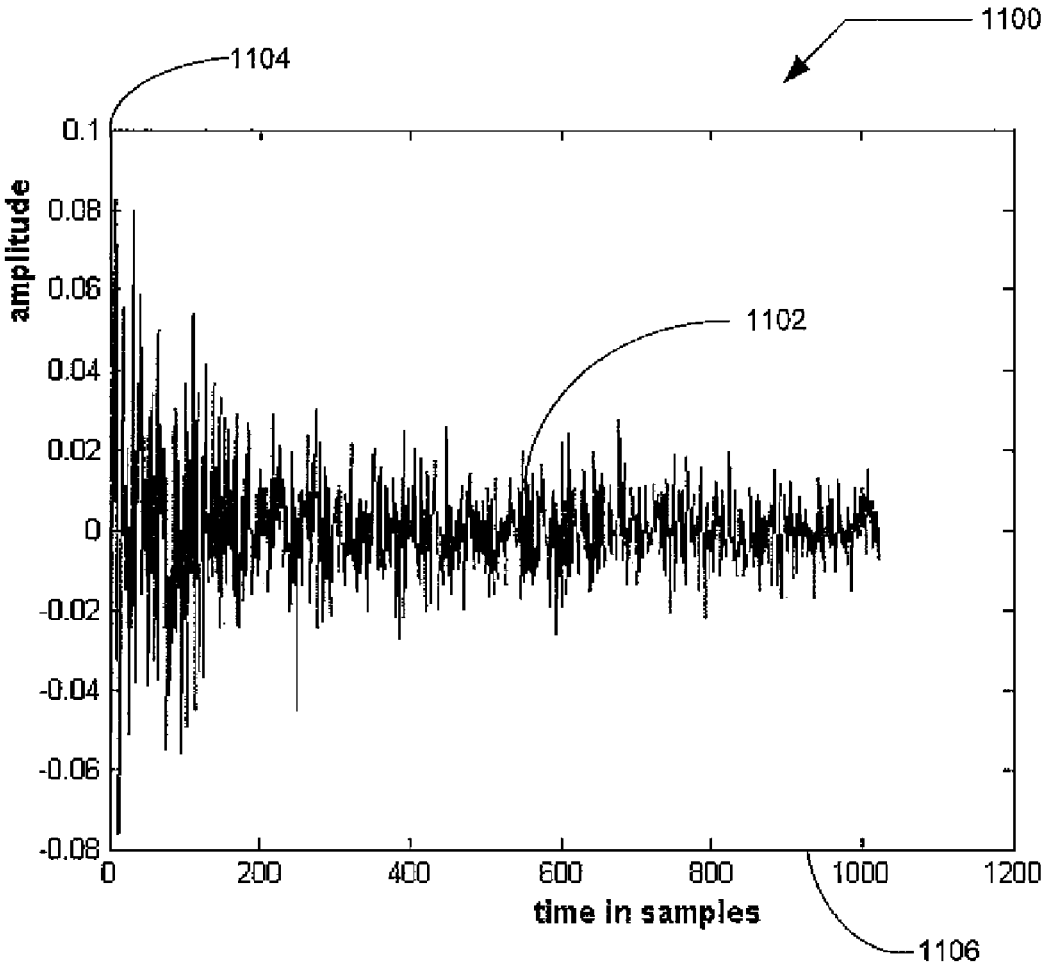
FIG. 11 is a graph 1100 of an example of an impulse response 1102 of the decorrelation filters 1006 and 1008 of FIG. 10.

Turning to FIG. 11, a graph 1100 of an example of an impulse response 1102 of the decorrelation filters 1006 and 1008 of FIG. 10 is shown. The vertical axis 1104 is the amplitude of the signal and the horizontal axis 1106 is the time in samples. The impulse response 1102 may be constructed by using an exponentially decaying random noise sequence.

Figure 12:
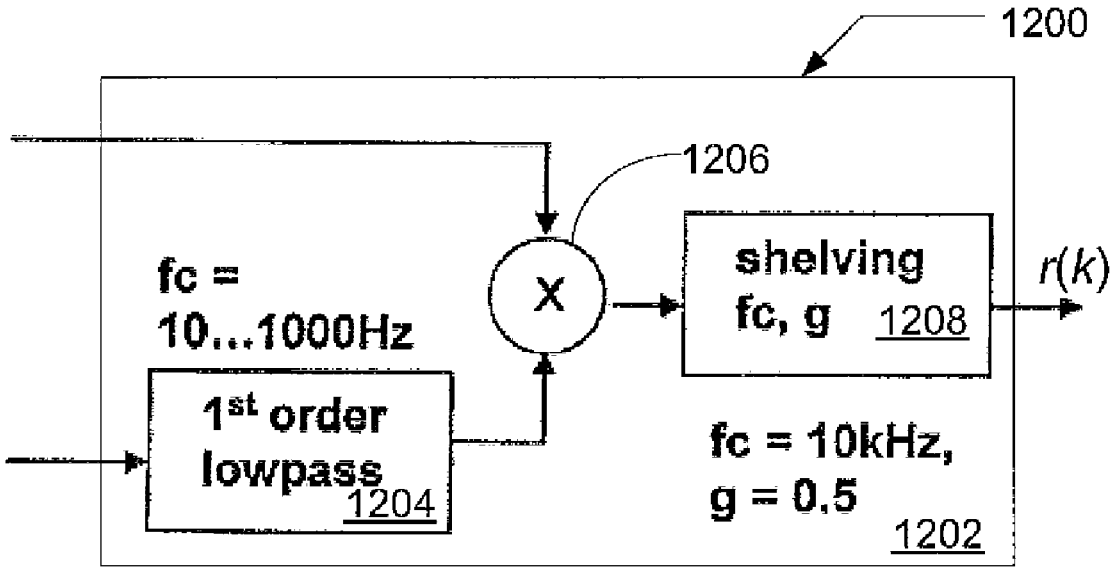
FIG. 12 is a block diagram representation 1200 of an example of a first portion of processing in the Room Response Generator 420 of FIG. 4.

Turning to FIG. 12, a block diagram 1200 of an example of a first portion 1202 of processing in the Room Response Generator 420 of FIG. 4. Two independent, random noise sequences are the inputs to the first portion 1202 of the RIR filter 1004. The two independent random noise sequences contain samples that are uniform or Gaussian distributed, with constant power density spectra (white noise sequence). The sequence lengths may be equal to the desired final length of the RIR. Such sequences can be generated with software, such at Matlab™ with the function "rand" or "randn", respectively. The second random noise sequence may be filtered by a first order lowpass filter of corner frequency $f_{cl}$, the value of which depends on the "room size" input parameter. For example, in the case where there are ten room sizes available (R-10), the parameter $f_{cl}$ may be obtained by the following logarithmic mapping of the 10 frequencies between 480 Hz and 19200 Hz:

$$f_{cl}(R\text{size})=[480, 723, 1090, 1642, 2473, 3726, 5614, 8458, 12744, 19200]\ \text{Hz}.$$

The first sequence may be element-wise multiplied using the multiplier 1206 by the second, lowpass filtered sequence. The result may be filtered with a first order shelving filter 1208 having a corner frequency $f_{cs}$=10 kHz and gain "g"=0.5 in the current implementation, in order to simulate wall absorption properties. The two parameters are normally fixed.

Figure 13:
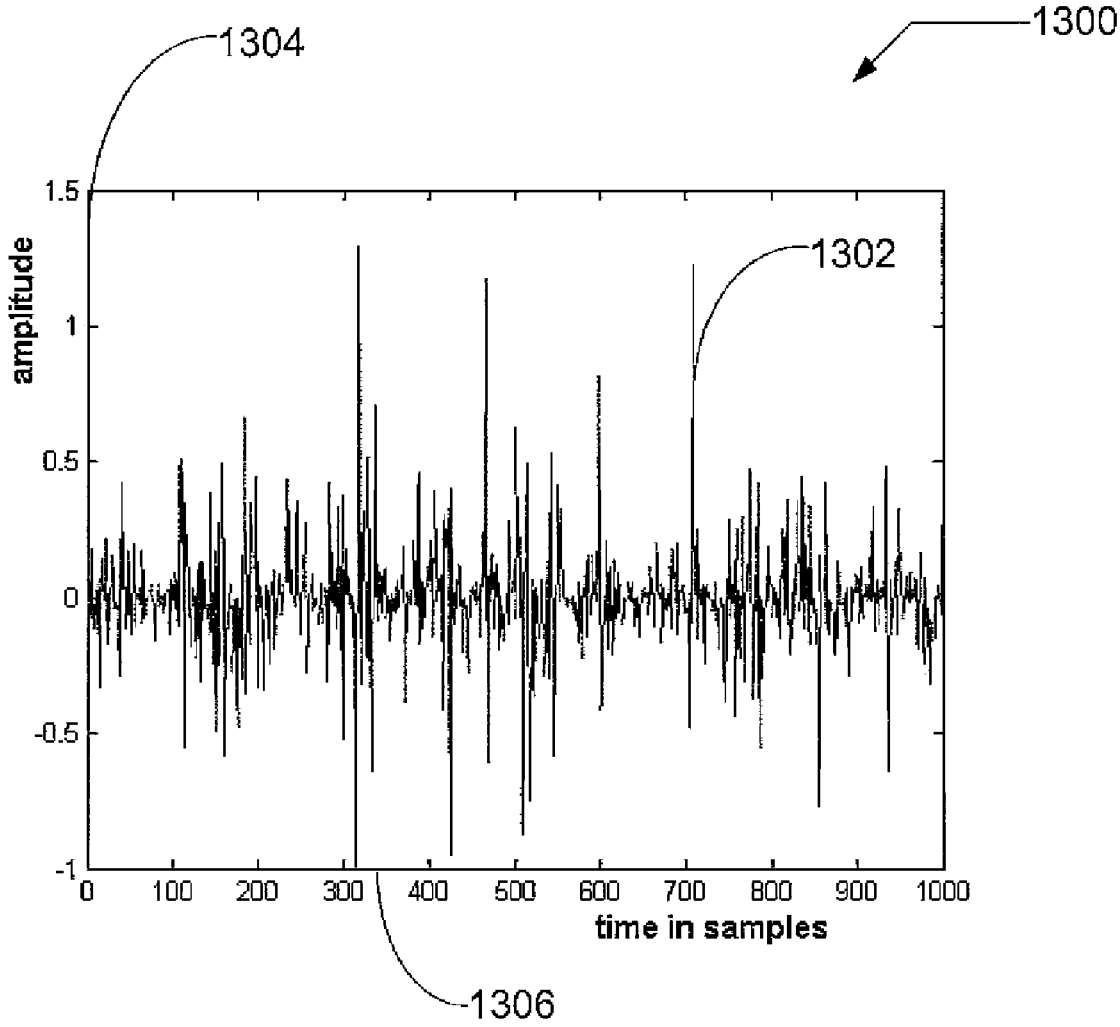
FIG. 13 is a graph 1300 that depicts a waveform 1302 of a typical sequence r(k) generated by the first portion 1202 of processing in the Room Response Generator 420 of FIG. 4.

In FIG. 13, a graph 1300 that depicts a waveform 1302 of a typical sequence r(k) generated by the first portion 1202 of processing in the Room Response Generator 420 of FIG. 4 is shown. The vertical axis 1304 is amplitude and the horizontal axis 1306 is the number of time samples. The waveform exhibits occurrences of high amplitudes with a low probability that resemble discrete room reflections. The density of the discrete reflections is higher at larger room sizes (higher $f_{cl}$). Larger rooms will therefore sound smoother, less "rough" to the human brain.

Figure 14:
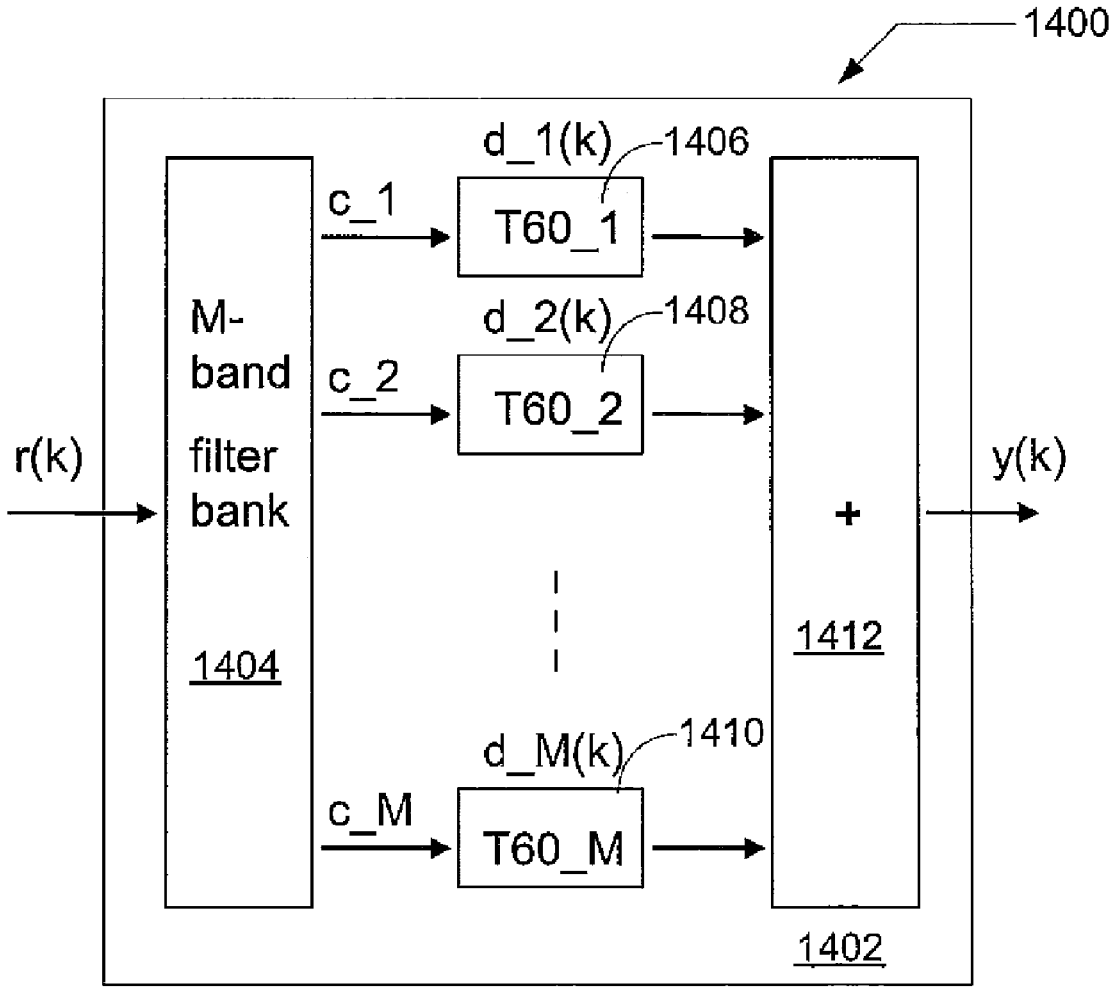
FIG. 14 is a block diagram representation 1400 of an example of a second portion 1402 of processing in the Room Response Generator 420 of FIG. 4.

Turning to FIG. 14 a block diagram 1400 of an example of a second portion 1404 of processing in the Room Response Generator 420 of FIG. 4. The second portion 1404 receives the r(k) signal or sequence from the first portion 1202 of FIG. 12. A filter bank 1404 further processes the received r(k) signal. The filters bank 1404 may split the signal into several sub-bands (M sub-bands). Each sub-band signal may be scaled by a predetermined gain factor "$c_i$" where i=1−M. Each of the respective $c_i$ filtered signal portions are then element-wise multiplied by an exponentially decaying sequence (a time window) $d_i(k)$ 1406, 1408 and 1410, characterized by a time constant $T_{60,i}$:

$$d_i(k) = e^{-\frac{3}{\log_{10}(e)T_{60,i}f_s}k}$$

T60,i are the reverb times in the i-th band and $f_s$ is the sample frequency (typically $f_s$=48 kHz). The sub-band signals may then be summed by a signal combiner 1412 or similar circuit to form the output sequence y(k).

Figure 15:
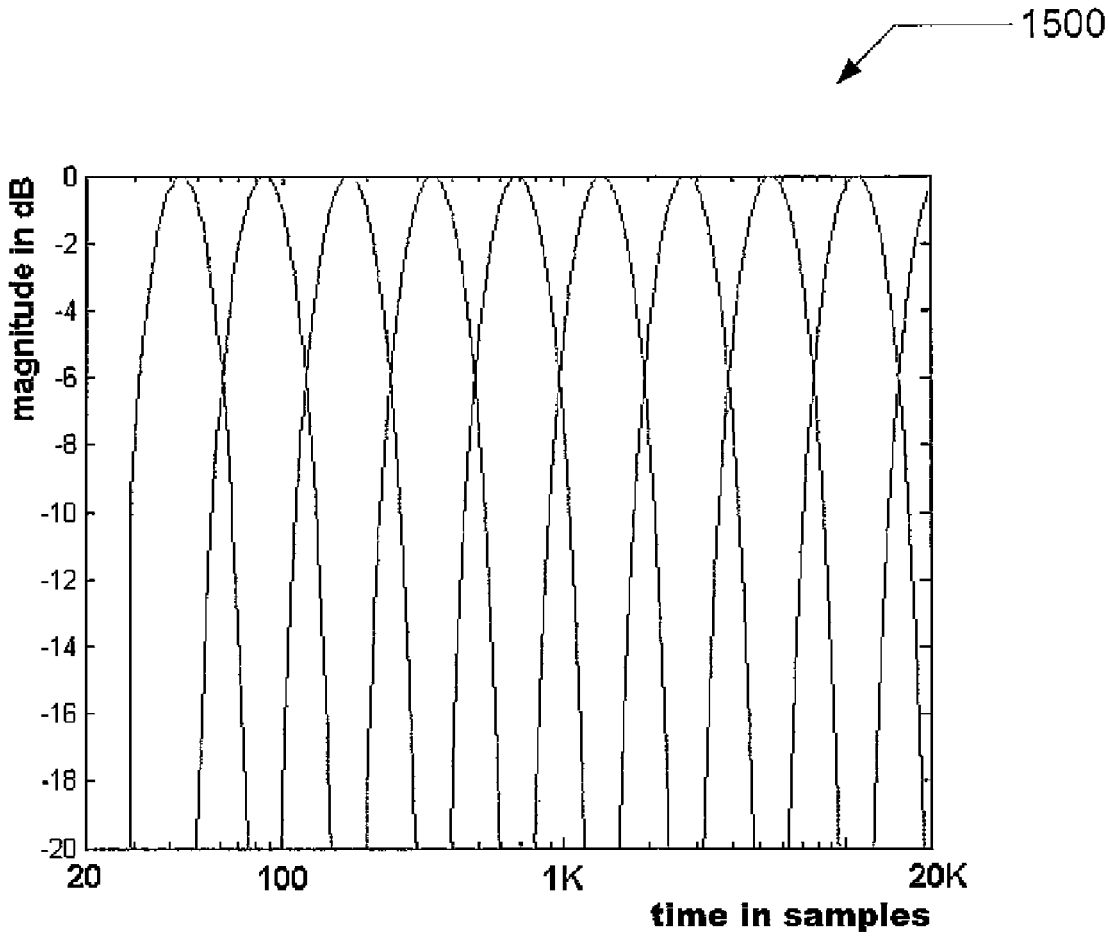
FIG. 15 is a graph 1500 that depicts the filter bank 1404 processing of r(k) signal received from the first portion 1202 of FIG. 12.

In FIG. 15, a graph 1500 that depicts the filter bank 1404 processing of r(k) signal received from the first portion 1202 of FIG. 12 is shown. The number of logarithmically spaced sub-bands may be set to ten (M=10). The each of the sub-bands overlap at −6 dB and sum up to constant amplitude. The corner frequencies fc are typically chosen to have logarithmic-octave spacing, such as fc(i)=[31.25 62.5 125 250 500 1000 2000 4000 8000 16000], i=1 . . . M.

Figure 16:
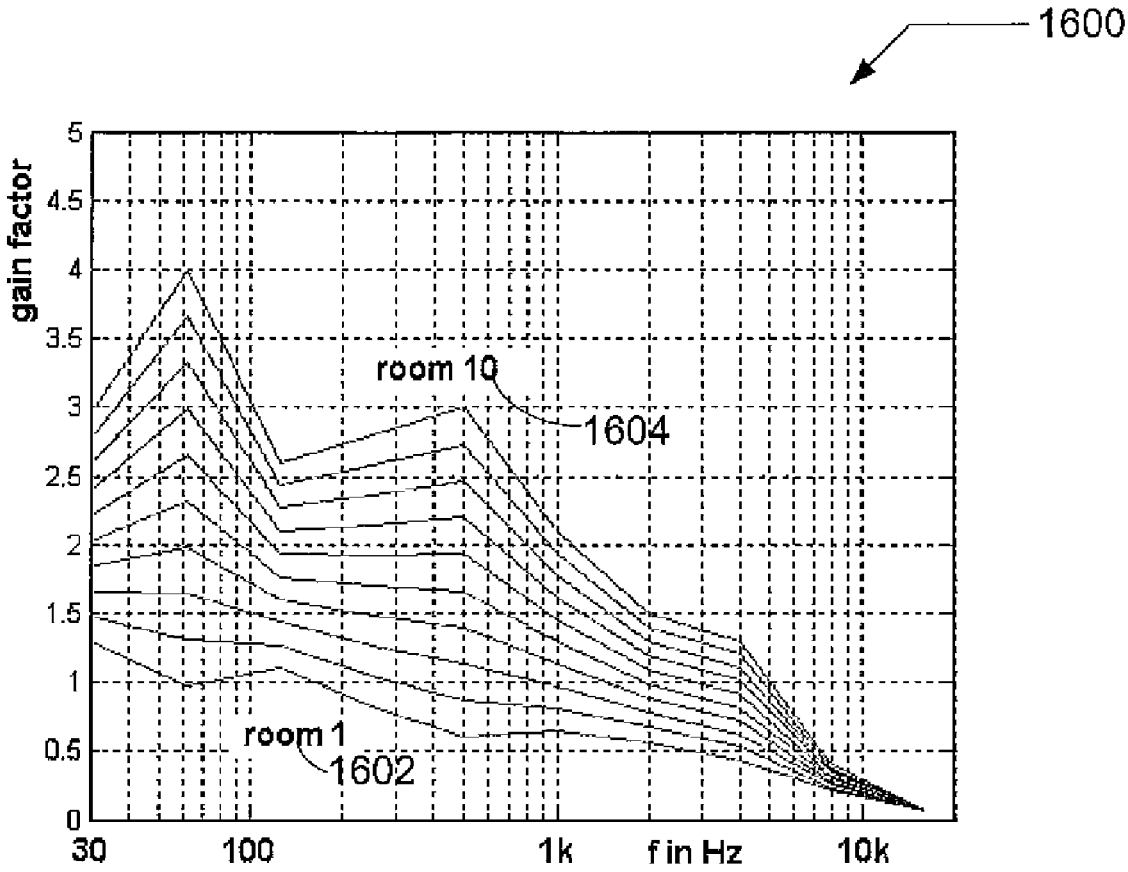
FIG. 16 is a graph 1600 of the gain factors ci for (i=1 . . . 10) with linear interpolation between the ten frequency points.

The frequencies for fc(i) above denote the crossover (−6 dB) points of filter bank 1404. The gain factors ci (i=1 . . . 10) with linear interpolation between the ten frequency points, are displayed in graph 1600 shown in FIG. 16. Room 1 plot 1602 in graph 1600 depicts the smallest room model and room 10 plot 1604 depicts the largest room model. The graph 1600 demonstrates that the larger the room model, the higher the gain will be at low frequencies.

The parameters above used to model the rooms may be obtained after measuring impulse responses in real halls of different sizes. The measured impulse responses may then be analyzed using the filter banks 1440. The energy in each band may then be measured and apparent peaks smoothed in order to eliminate pronounced resonances that could introduce unwanted colorations of the final audio signals.

Figure 17:
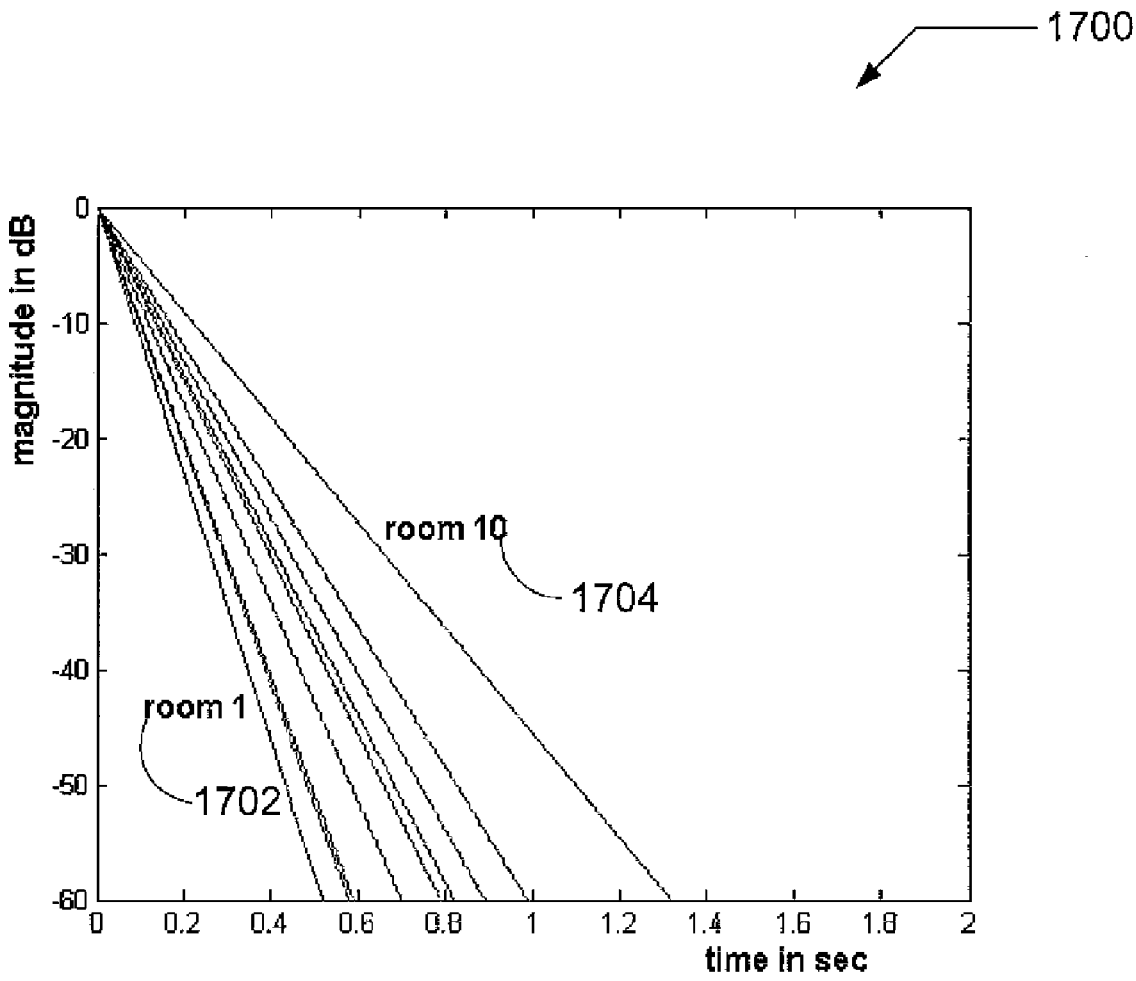
FIG. 17 is a graph 1700 that depicts the logarithmic magnitudes of the time window functions in seconds for rooms 1 . . . 10.
Figure 18:
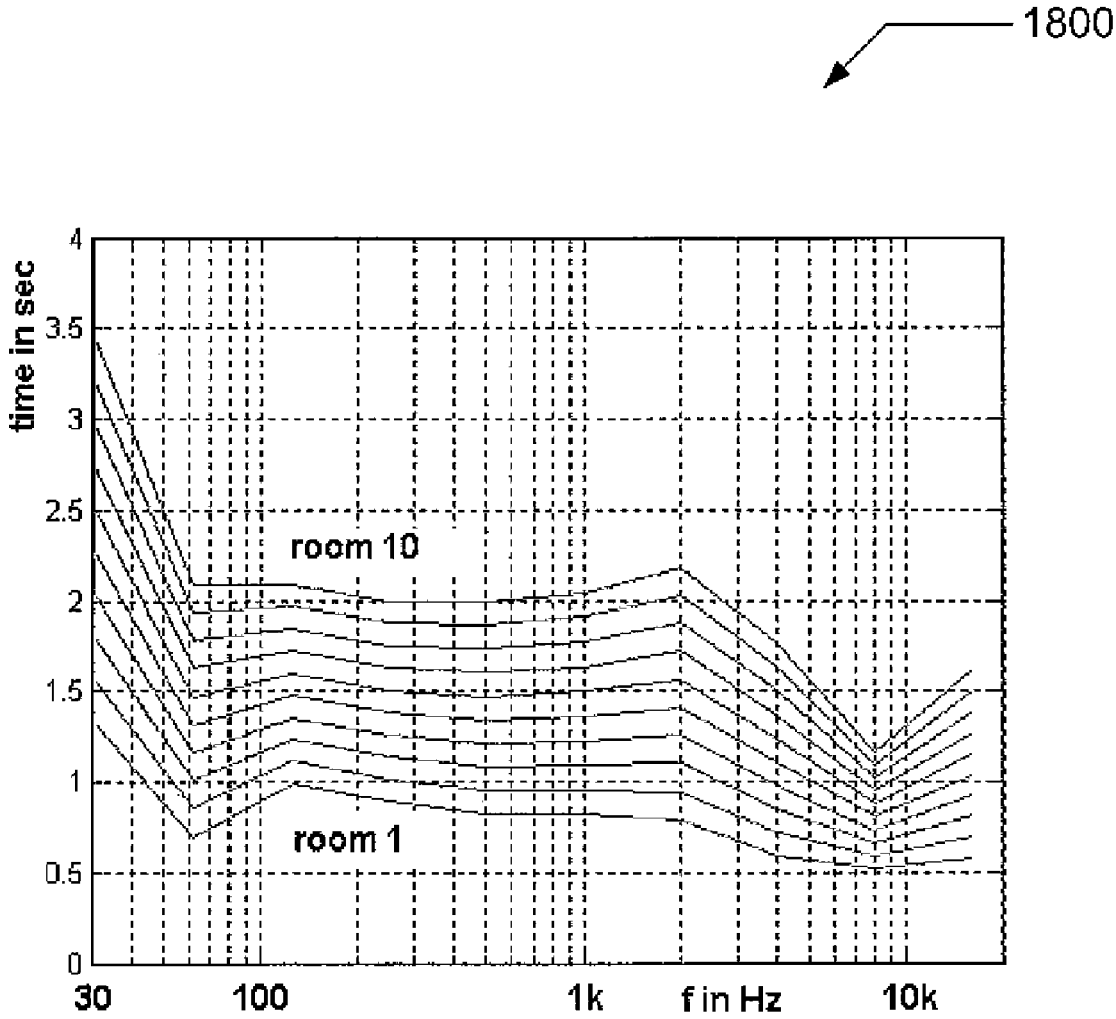
In FIG. 18 is a graph 1800 that depicts the chosen reverb times over frequency for rooms 1 . . . 10.

In FIG. 17, a graph 1700 that depicts the logarithmic magnitudes of the time window functions for room 1 1702 to room 10 1704 in seconds at a frequency band i=7 (8458 Hz) is shown. The exponential decay corresponds to a linear one in the logarithmic plots of graph 1700. The reverb time $T_{60}$ is the point where the curves cross the time axis at the magnitude of −60 dB. In FIG. 18, a graph 1800 that depicts the chosen reverb times over frequency for rooms 1 . . . 10 is shown. The parameters have been chosen such that the model for the rooms 1 . . . 10 fits smoothed versions of the various measured rooms and hulls.

Figure 19:
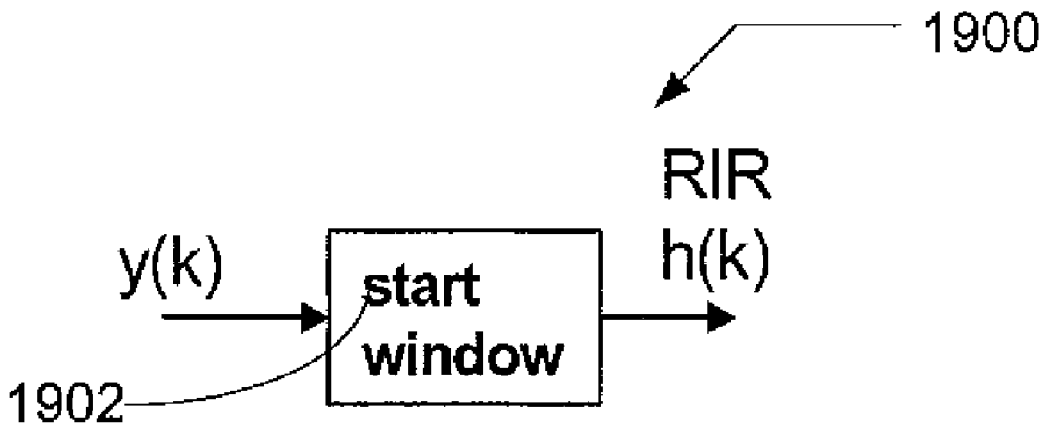
FIG. 19 is a block diagram representation 1900 of the last portion 1902 of the Room Response Generator 420 of FIG. 4.
Figure 20:
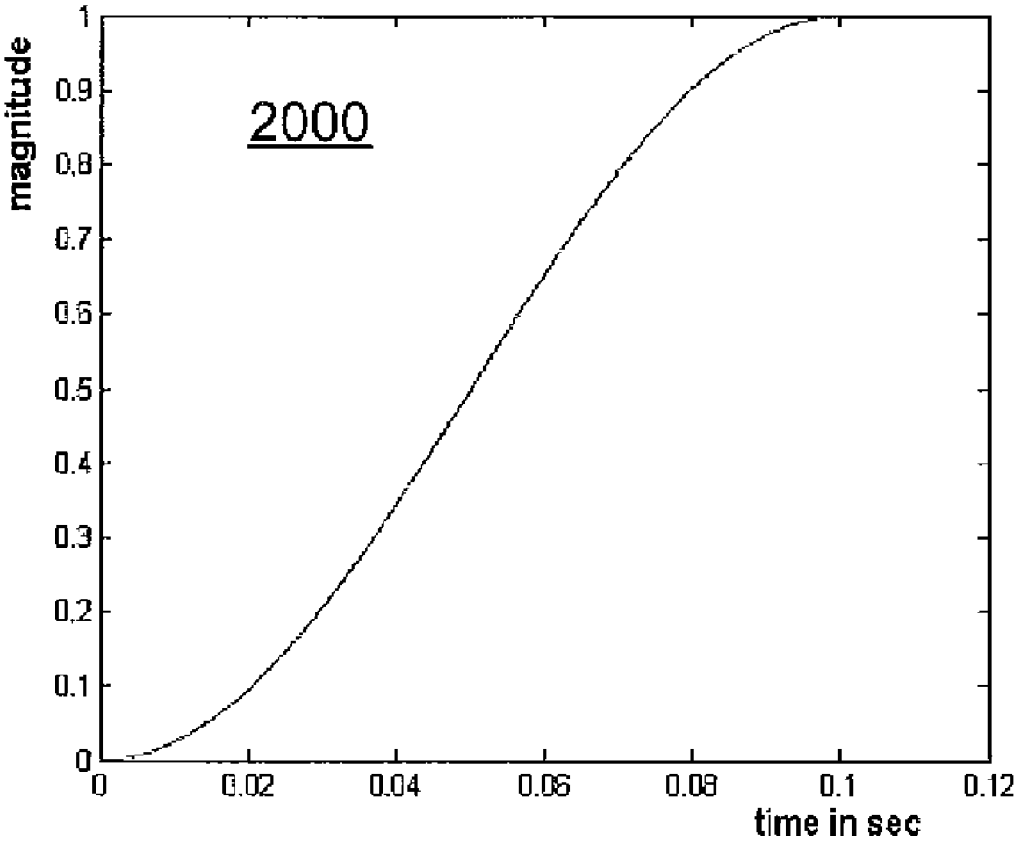
FIG. 20 is a graph 2000 that depicts the gentler build-up of reflective energy using a half Hanning window of the last portion 1902 of FIG. 19.
Figure 21:
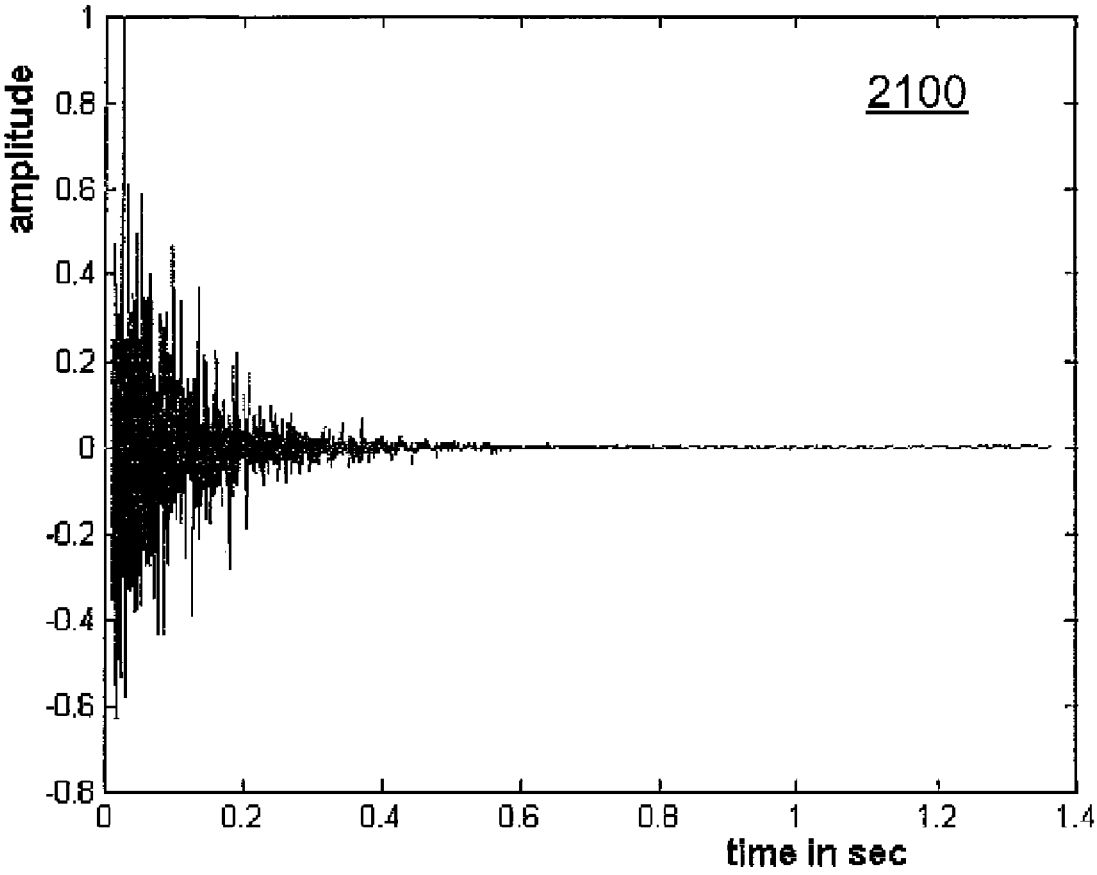
FIG. 21 is a graph that depicts the final results 2100 generated by the Room Response Generator 420 of FIG. 4.
Figure 22:
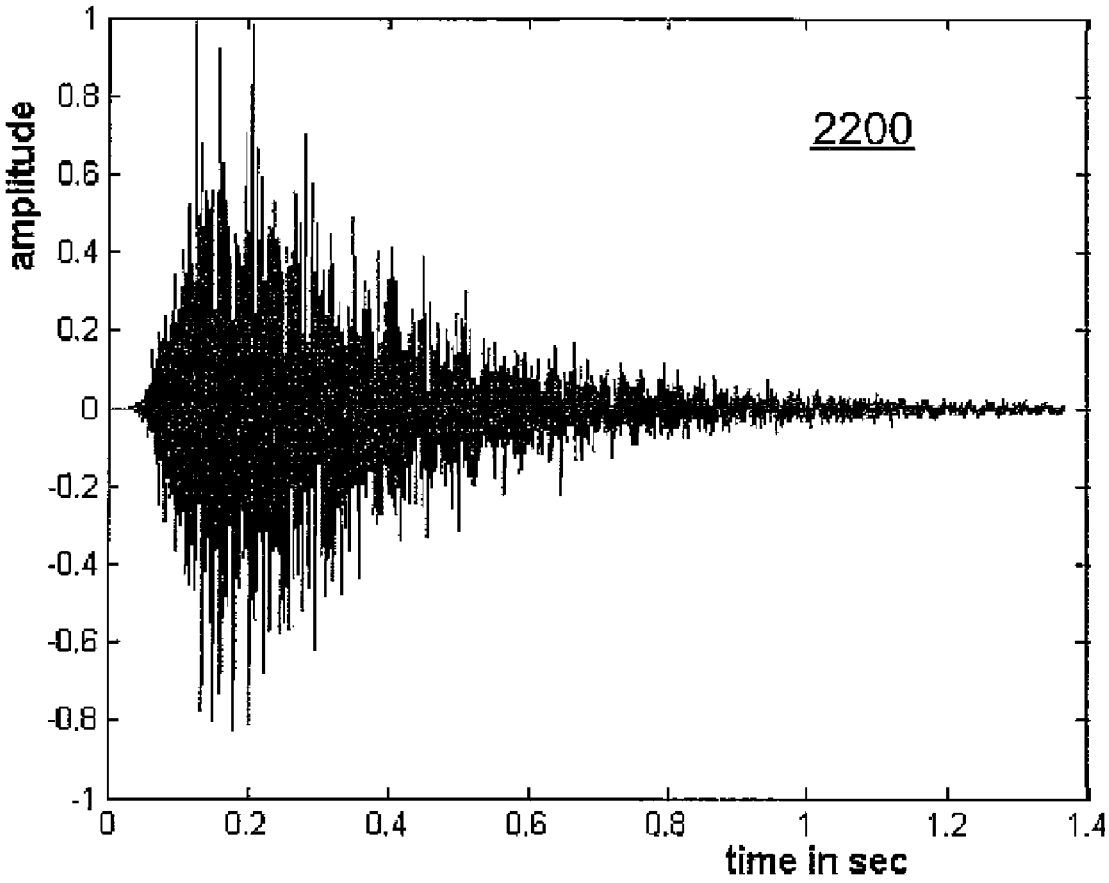
FIG. 22 is a graph that depicts the samples of a room impulse response 2200 generated by Room Response Generator 420 of FIG. 4.

Turning to FIG. 19, a block diagram 1900 of the last portion 1902 of the RIR filter 1004 of FIG. 10 is shown. The last portion 1902 starts the time window to shape the initial part of the modeled impulse response y(k). The time window is a half Hanning window, as is available as function Hann.m in MATLAB™. The window length may vary linearly between zero and about 150 msec for the largest room. The window models a gentler build-up of reflective energy that may be observed in a room (especially in large rooms) and adds clarity and speech intelligibility. The output of the last portion 1902 of the Room Response Generator 420 of FIG. 4 is the h(k) impulse response, the coefficients of the RIR filter 1004 of FIG. 10. A graph 2000 in FIG. 20 depicts the gentler build-up of reflective energy of the half Hanning window. In FIGS. 21 and 22, the final results (i.e. samples of room impulse response) generated by the RIR (room 1 and 10 respectively) are shown.

Figure 23:
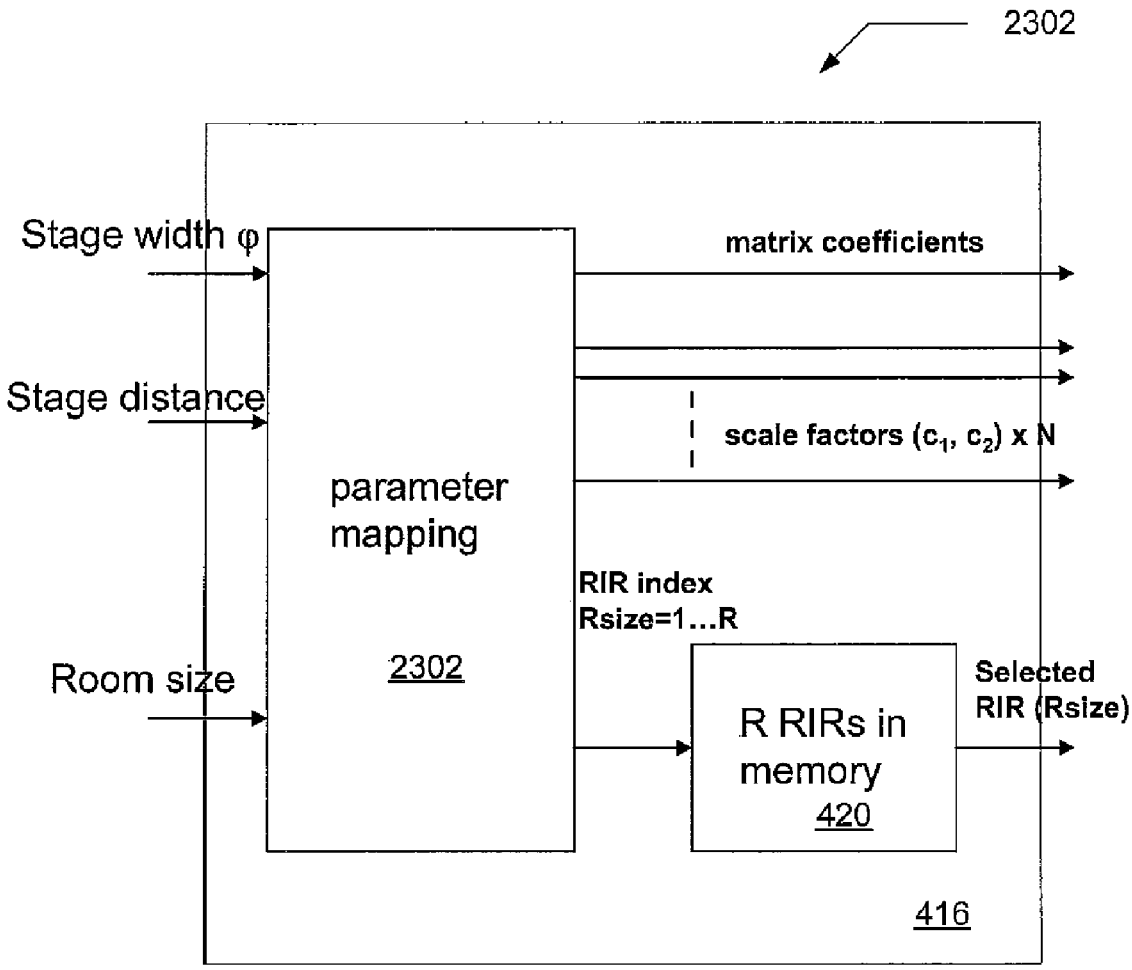
FIG. 23 is a block diagram representation of the user response processor 416 of FIG. 4.

In FIG. 23, a block diagram 2302 of the URP 416 of FIG. 4 is shown. The user response processor 416 computes the parameters used by the SPSS 304, based upon a limited number of user input parameters (three in the current implementation). Variables that are used by the SPSS 304 may be the angle that controls the stage width, delays $T_1$ . . . $T_N$ to control the temporal distribution of early reflections, coefficients $c_{11}$ . . . $c_{1N}$ to control the energy of discrete reflections, coefficients $c_{21} \ldots c_{2N}$ to control the energy of RIR responses, and the RIR according to the desired Room Size. The input parameters are mapped to variables and equations in the parameter mapping area of memory. The parameter mapping area of memory is accessed and the formulas and data described previous are used to generate the variables used by the SPSS 304 and to determine the RIRs in memory 420. The URP 416 computes new coefficients sets and selects RIRs in response to a change in any of the input parameters associated with the spatial attributes (stage width, stage distance and room size).

Means may be provided to assure smooth transitions between the parameter settings when parameters are change, such as interpolation techniques. The number of input parameters may be further reduced by, for example, combining stage distance and room size to one parameter that are controlled simultaneously with a single input device, such as a knob or keypad.

Figure 24:
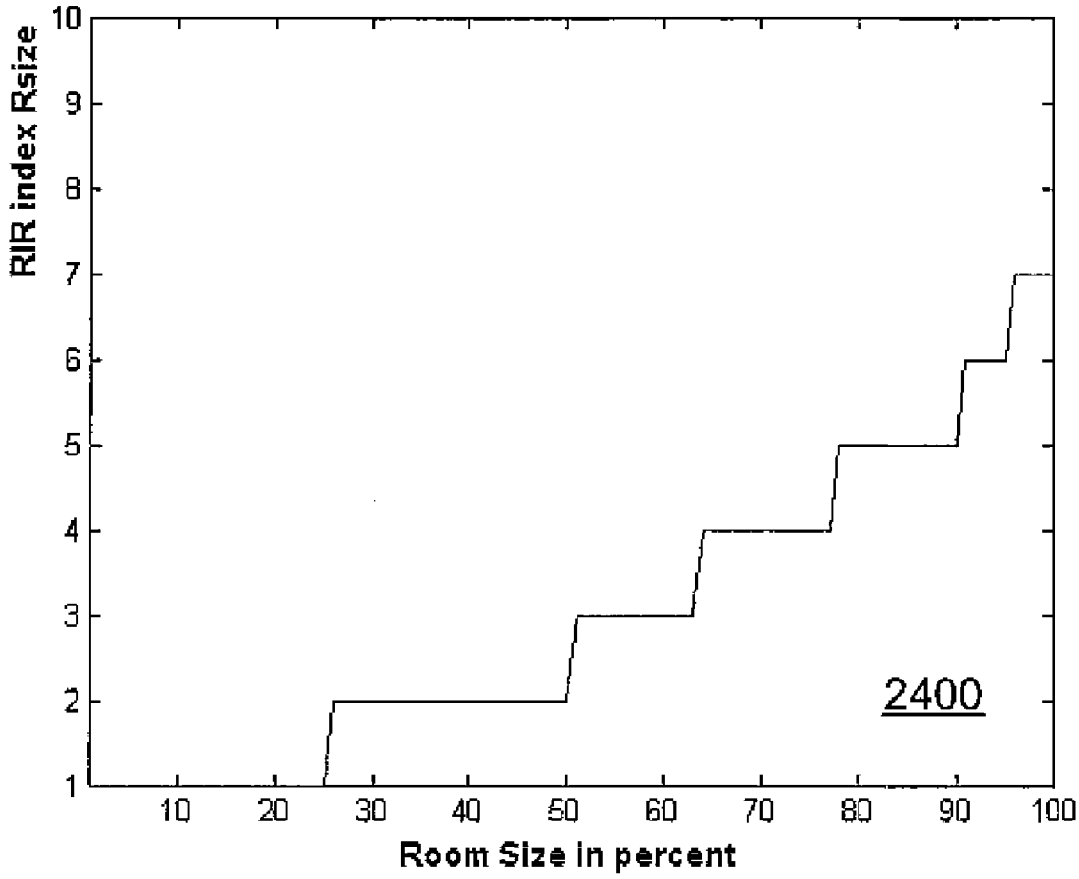
FIG. 24 is a graph 2400 of a defined mapping for impulse response one to seven employed by the user response processor 416 of FIG. 4.
Figure 25:
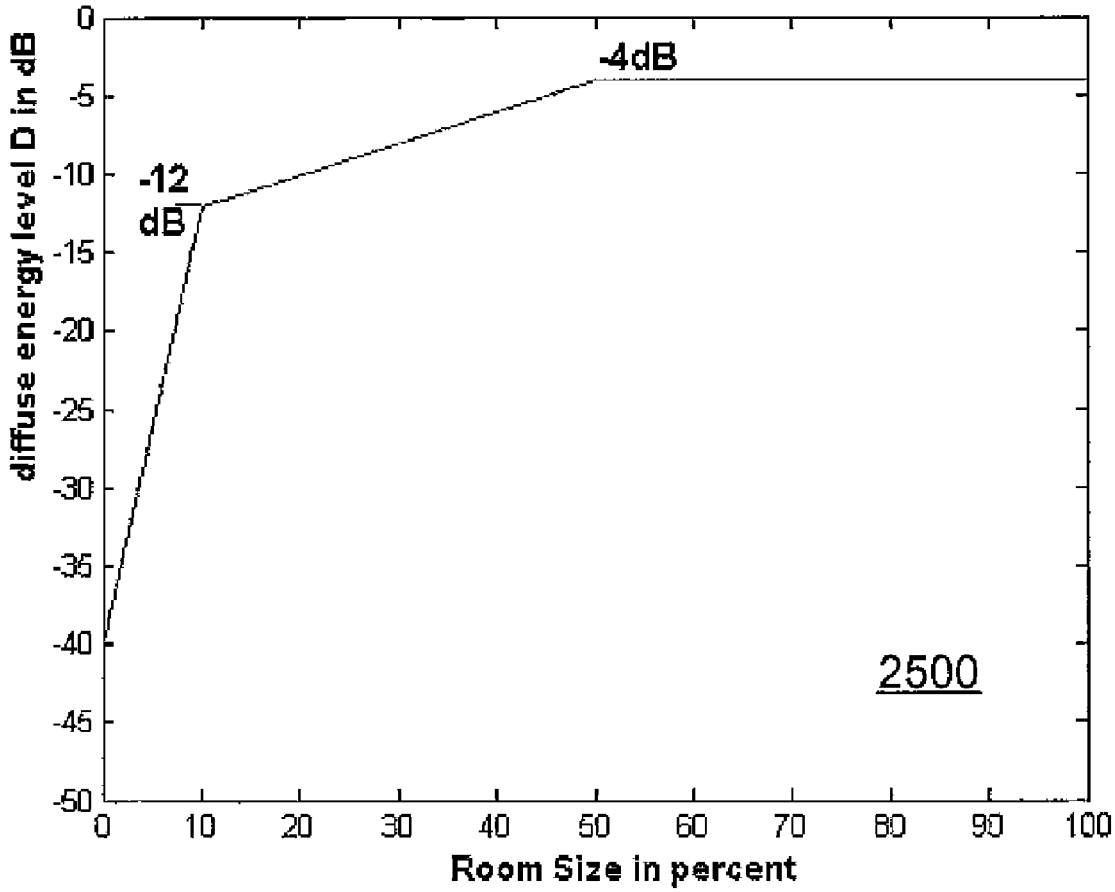
FIG. 25 is a graph 2500 of the diffuse energy levels employed by the user response processor 416 of FIG. 4.

In FIG. 24, a graph 2400 of a defined mapping for impulse response for RIR of 1 to 7 employed by the user response processor 416 of FIG. 4 is shown. The mappings have been empirically optimized in terms of perceived loudness, regardless of input signals and chosen room width setting, and in terms of uniformity of the image across the frontal stage. In FIG. 25, a graph 2500 of the diffuse energy levels employed by the user response processor 416 of FIG. 4 is shown. The room size may also scale the reflection delay values $T_i$ in FIG. 5. In large rooms, walls are farther apart, thus discrete reflections are spread over larger time intervals. Typical values for a system with four surround channels are:

$T_1$=s·8 msec, $T_2$=s·11 msec, $T_3$=s·7 m sec, $T_4$=s·13 msec, where s=0.5+Rsize/50.

Figure 26:
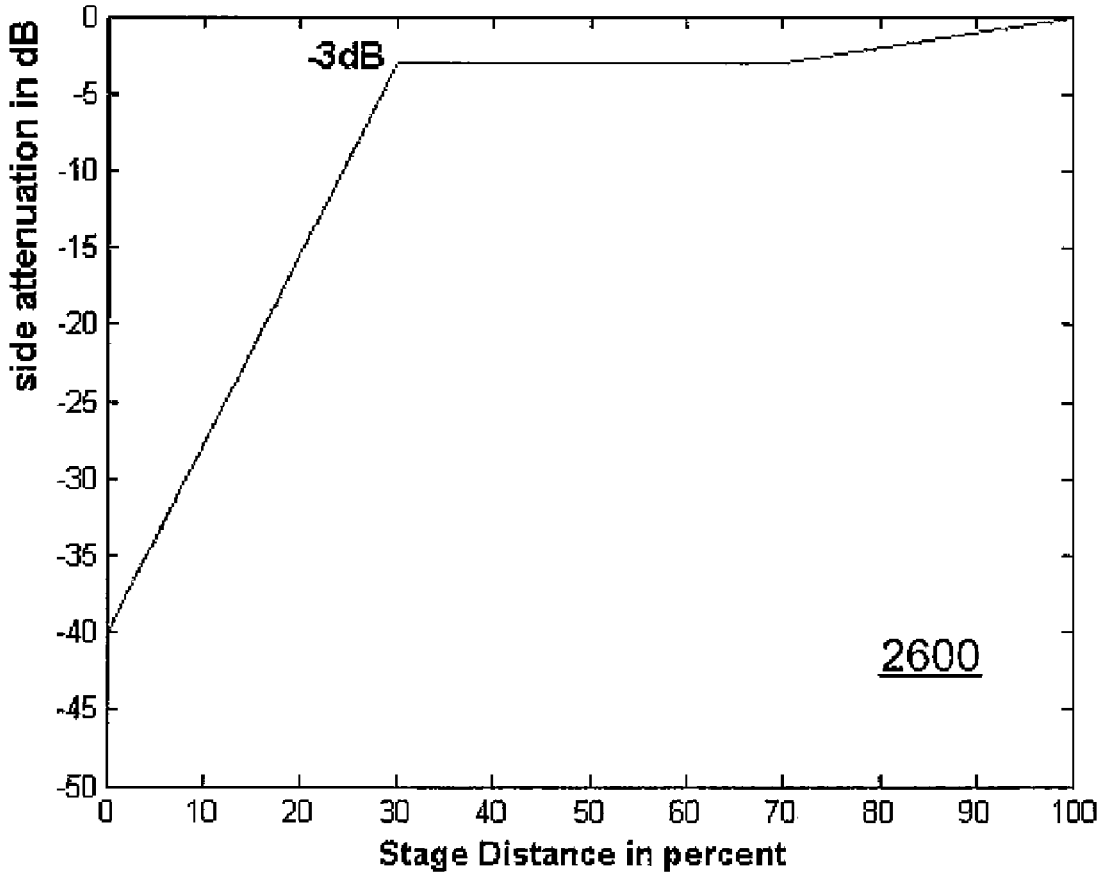
FIG. 26 is a graph 2600 of the attenuation of discrete reflections of the side channel audio signals.
Figure 27:
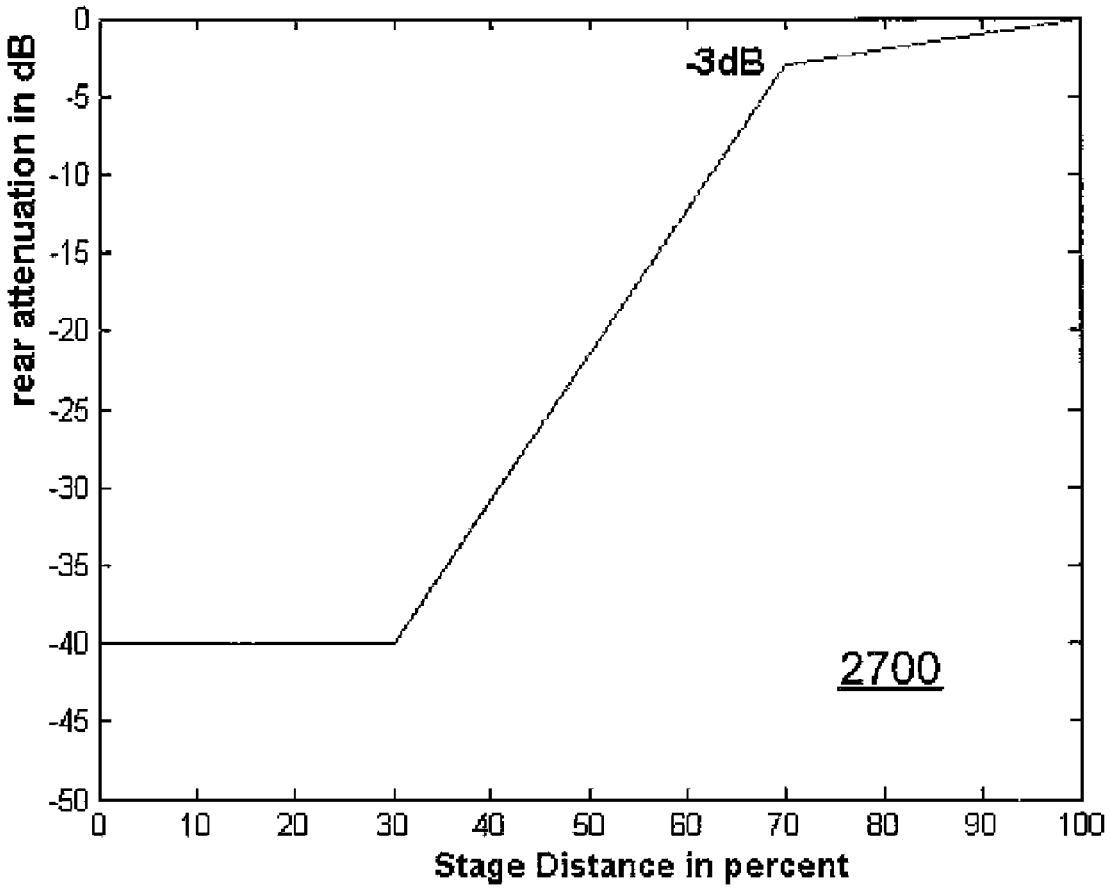
FIG. 27 is a graph 2700 of the attenuation of the rear channel audio signal reflections.

In FIG. 26, a graph 2600 of the attenuation of discrete reflections of the side channel audio signals Ls and Rs with parameters c11 and c13 of FIG. 8 is shown. The stage distance controls the attenuation of discrete reflections of the side channels and in FIG. 27, a graph 2700 of the attenuation of the rear channel audio signal reflections c12 and c14 of FIG. 8 is shown.

Figure 28:
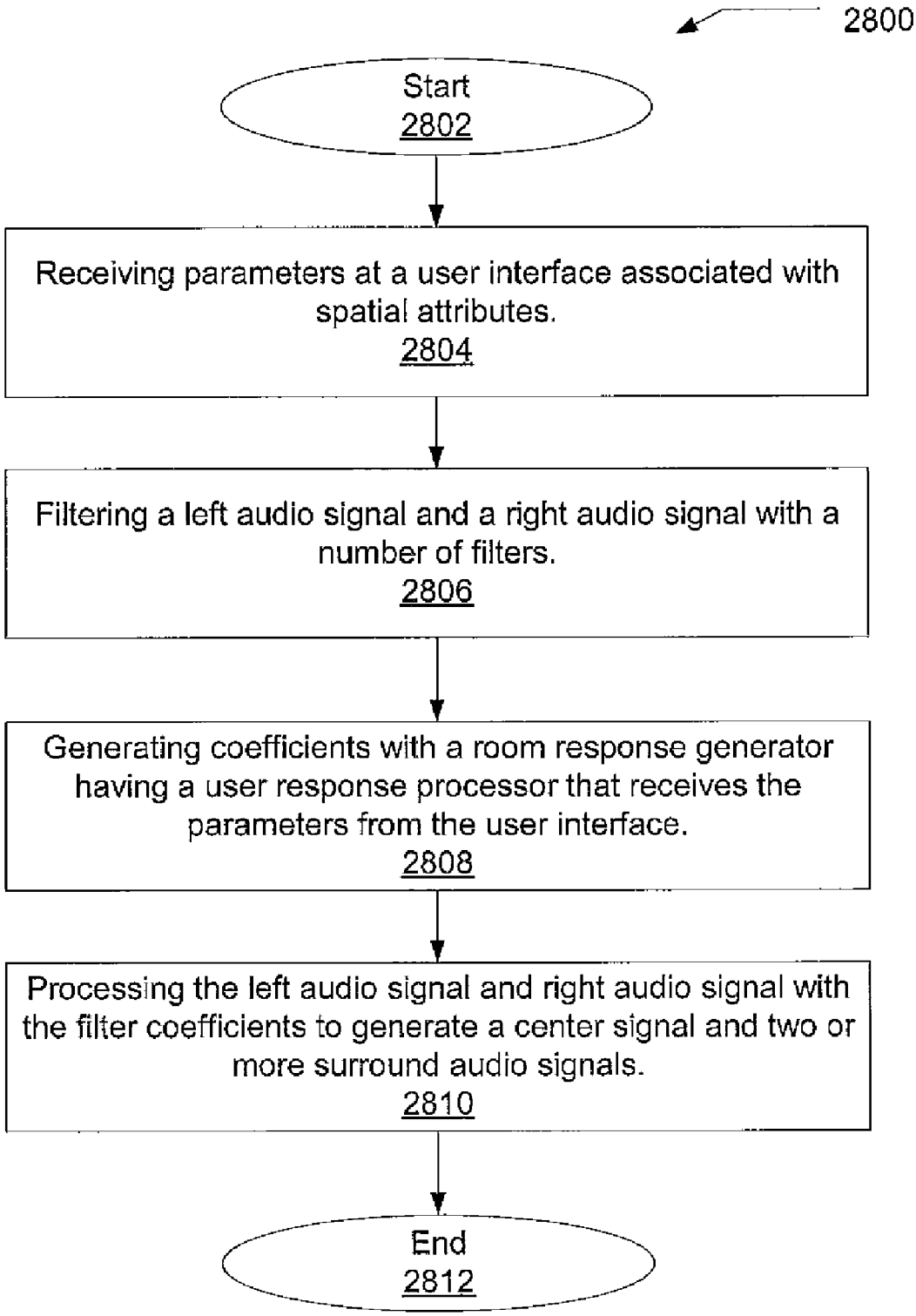
FIG. 28 is flow diagram of an approach for spatial processing in a spatial processing stereo system.

Turning to FIG. 28, a flow diagram 2800 of an approach for spatial processing in a SPSS such as 204 or 304 is depicted. The flow diagram starts 2802 with receipt of parameters at a user interface associated with spatial attributes, such as room size, stage distance and stage width 2804. The SPSS 204 may also receive a right audio signal and a left audio signal from an audio device. The right audio signal and left audio signal may be filtered by a number of filters 2806, where the filters may use coefficients that are generated by a user response processor that processes the parameters inputted at the user interface 2806. The user response processor uses coefficients stored in memory that have been generated by a room response generator. The left audio signal and right audio signal are processed using the filter coefficients to generate a center signal and/or two or more surround audio signals 2810. The flow diagram is shown as ending 2812, but in practice it is a continuous flow that generates the two or more surround audio signals.

Persons skilled in the art will understand and appreciate, that one or more processes, sub-processes, or process steps may be performed by hardware and/or software. Additionally, the SPSS described above may be implemented completely in software that would be executed within a processor or plurality of processors in a networked environment. Examples of a processor include but are not limited to microprocessor, general purpose processor, combination of processors, DSP, any logic or decision processing unit regardless of method of operation, instructions execution/system/apparatus/device and/or ASIC. If the process is performed by software, the software may reside in software memory (not shown) in the device used to execute the software. The software in software memory may include an ordered listing of executable instructions for implementing logical functions (i.e., "logic" that may be implemented either in digital form such as digital circuitry or source code or optical circuitry or chemical or biochemical in analog form such as analog circuitry or an analog source such an analog electrical, sound or video signal), and may selectively be embodied in any signal-bearing (such as a machine-readable and/or computer-readable) medium for use by or in connection with an instruction execution system, apparatus, or device, such as a computer-based system, processor-containing system, or other system that may selectively fetch the instructions from the instruction execution system, apparatus, or device and execute the instructions. In the context of this document, a "machine-readable medium," "computer-readable medium," and/or "signal-bearing medium" (herein known as a "signal-bearing medium") is any means that may contain, store, communicate, propagate, or transport the program for use by or in connection with the instruction execution system, apparatus, or device. The signal-bearing medium may selectively be, for example but not limited to, an electronic, magnetic, optical, electromagnetic, infrared, or semiconductor system, apparatus, device, air, water, or propagation medium. More specific examples, but nonetheless a non-exhaustive list, of computer-readable media would include the following: an electrical connection (electronic) having one or more wires; a portable computer diskette (magnetic); a RAM (electronic); a read-only memory "ROM" (electronic); an erasable programmable read-only memory (EPROM or Flash memory) (electronic); an optical fiber (optical); and a portable compact disc read-only memory "CDROM" (optical). Note that the computer-readable medium may even be paper or another suitable medium upon which the program is printed, as the program can be electronically captured, via, for instance, optical scanning of the paper or other medium, then compiled, interpreted or otherwise processed in a suitable manner if necessary, and then stored in a computer memory. Additionally, it is appreciated by those skilled in the art that a signal-bearing medium may include carrier wave signals on propagated signals in telecommunication and/or network distributed systems. These propagated signals may be computer (i.e., machine) data signals embodied in the carrier wave signal. The computer/machine data signals may include data or software that is transported or interacts with the carrier wave signal.

While the foregoing descriptions refer to the use of a wide band equalization system in smaller enclosed spaces, such as a home theater or automobile, the subject matter is not limited to such use. Any electronic system or component that measures and processes signals produced in an audio or sound system that could benefit from the functionality provided by the components described above may be implemented as the elements of the invention.

Moreover, it will be understood that the foregoing description of numerous implementations has been presented for purposes of illustration and description. It is not exhaustive and does not limit the claimed inventions to the precise forms disclosed. Modifications and variations are possible in light of the above description or may be acquired from practicing the invention. The claims and their equivalents define the scope of the invention.

What is claimed is:

1. A spatial processing stereo system (SPSS), comprising:

a plurality of filters for filtering a left audio signal and a right audio signal;

a room response generator;

a user interface for entry of parameters associated with the spatial attributes of a room;

a user response processor that receives the parameters from the user interface and generates coefficients that are used by at least one of the plurality of filters and being in receipt of a room impulse response that is also used by at least one of the plurality of filters; and at least two additional audio signals that are generated with filters that use the coefficients filtering the left audio signal and right audio signal with a signal processor that receives at least the right audio and the left audio signal and generates at least a left signal, a first left surround signal, a right signal and a first right surround signal with a coefficient matrix using the coefficients where the signal processor includes a pair of shelving filters and a pair of delay lines and generates at least a second left surround signal and a second right surround signal.

2. The SPSS of claim 1, where the signal processor includes a fast convolution processor that generates a third left surround signal and a third right surround signal using at least one of the coefficients.

3. The SPSS of claim 2, where the first left surround signal is combined with the second left surround signal and third left surround signal and the first right surround signal is combined with, the second right surround signal and third right surround signal and results in the left surround signal output and the right surround signal output.

4. The SPSS of claim 2, where the fast convolution processor, further includes a decimation filter that reduces the sample rate of the left audio signal and the right audio signal as a combined audio signal, and is coupled to at least a pair of all-pass filters to generate the third left surround signal and the third right surround signal.

5. The SPSS of claim 4, where the fast convolution processor further includes a two by two matrix having the left surround signal and the right surround signal at the input and generating a left back surround signal and aright back surround signal.

6. The SPSS of claim 1, where a plurality of delay parameters are used with the shelving filter that result in delayed signals, where the delayed signals are the left surround signal and the right surround signal.

7. The SPSS of claim 1, where the coefficient matrix further includes a variable matrix used with the left audio signal and right audio signal to generate the first left signal and the first right.

8. The SPSS of claim 7, where the coefficient matrix further includes a fixed matrix used with the left audio signal and right audio signal to generate a left surround signal and right surround signal.

9. The SPSS of claim 8, where a scaling factor associated with a stage width, parameter that is one of the spatial attributes of the room is applied to the first right signal, first left signal, left surround signal, and right surround signal.

10. The SPSS of claim 1, where the room response generator further includes a M band filter bank, where the shelving filter receives the element-wise product of a first random noise input and a lowpass filtered second random noise input and an output of the shelving filter is processed by the M-band filter bank in order to generate the room impulse response.

11. A method for spatial processing in a spatial processing stereo system (SPSS), comprising:

receiving parameters at a user interface associated with spatial attributes of a room;

filtering a left audio signal and a right audio signal with a plurality of filters;

generating with a room response generator having a user response processor that receives the parameters from the user interface, coefficients that are used by at least one of the plurality of filters that is in receipt of a room impulse response; and processing the left audio signal and right audio signal with the at least one of the plurality of filters to generate at least two other surround audio signals with a processor that receives at least the right audio signal and the left audio signal and generates at least a left signal, a first left surround signal, a first right surround signal with a coefficient matrix using the coefficients where the signal processor includes a pair of shelving filters and a pair of delay lines and at least a second left surround signal and a second right surround signal.

12. The method of spatial processing of claim 11, further includes determining the room impulse response with the room response generator with at least one of the parameters that is an input room size parameter and is associated with a room size spatial attribute.

13. The method of spatial processing of claim 11, further including determining a plurality of coefficients to scale the amplitudes of the delayed left audio signal and right audio signals from at least one of the parameters associated with the spatial attribute of a stage distance.

14. The method of spatial processing of claim 13, includes generating the second left surround signal and the second right surround signal with a shelving filters that use delay amplitude scale coefficients.

15. The method of spatial processing of claim 11, further includes generating a second left surround signal and a second right surround signal by filtering a combined left audio signal and right audio signal with a decimation filter and an all-pass filter.

16. The method of spatial processing of claim 11, further includes determining a plurality of scale factors from at least one of the parameters which is associated with a stage width spatial attributes.

17. The method of spatial processing of claim 16, includes generating a center audio signal with a signal combiner that uses a scale factor.

18. The method of spatial processing of claim 11, where the generating the at least two other audio signals occurs in a digital signal, processor (DSP).

19. The method of spatial processing of claim 11, including generating a center audio signal from the right audio signal and left audio signal.

20. A spatial processing stereo system (SPSS), comprising:

a plurality of filters for filtering a left audio signal and a right audio signal;

a room response generator;

a user interface for entry of parameters associated with spatial attributes that include a room size spatial attribute, a stage width spatial attribute and a stage distance spatial attribute;

a user response processor that receives the parameters from the user interface and generates coefficients that are used by at least one of the plurality of filters;

a room response generator that determines the room impulse response for the room size spatial attribute, where the impulse response is used by at least one of the plurality of filters; and at least two additional, audio signals that are generated with filters that use the coefficients with the left audio signal and right audio signal.

21. The SPSS of claim 20, further includes generation of a center audio signal from the left audio signal and right audio signal, where the generation of the center audio signal uses the parameter associated with the stage distance spatial attribute.

22. A spatial processing stereo system (SPSS), comprising:

a plurality of filters for filtering a left audio signal and a right audio signal;

a room response generator;

a user interface for entry of parameters associated with spatial attributes of a room;

a signal processor that receives at least the right audio signal and the left audio signal and generates at least a left signal and right signal and center signal with a coefficient matrix using the coefficients generated from at least one of the parameters and a shelving filter that receives delay amplitude scale coefficients derived from at least one of the parameters and generates at least a first left surround signal and a first right surround signal;

a user response processor that receives the parameters from the user interface and generates coefficients that are used by at least one of the plurality of filters and being in receipt of a room impulse response that is also used by at least one of the plurality of filters; and at least two additional audio signals that are generated with filters that use the coefficients filtering the left audio signal and right audio signal and where the signal processor includes a fast convolution processor that generates a second left surround signal and a second right surround signal using at least one of the parameters.

* * * * *